US006333724B1

(12) United States Patent
Taira et al.

(10) Patent No.: US 6,333,724 B1
(45) Date of Patent: Dec. 25, 2001

(54) DISPLAY DEVICE

(75) Inventors: Kazuki Taira, Kawasaki; Masaaki Tamatani, Fujisawa; Yasushi Kawata, Yokohama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/149,041

(22) Filed: Sep. 8, 1998

(30) Foreign Application Priority Data

Sep. 8, 1997 (JP) ..... 9-242724

(51) Int. Cl.[7] ..... G09G 5/00

(52) U.S. Cl. ..... 345/5; 345/3.1; 349/60; 349/61

(58) Field of Search ..... 345/4, 5, 3.1, 32; 348/750–753, 759–763, 766–768; 349/60, 61, 96

(56) References Cited

U.S. PATENT DOCUMENTS

| | | | | |
|---|---|---|---|---|
| 5,387,920 | | 2/1995 | Bos et al. . | |
| 5,570,140 | * | 10/1996 | Toide et al. | 348/744 |
| 5,570,216 | * | 10/1996 | Lu et al. | 359/101 |
| 5,587,816 | | 12/1996 | Gunjima et al. . | |
| 5,654,775 | * | 8/1997 | Brennesholtz | 348/742 |
| 5,737,042 | * | 4/1998 | Shinohara et al. | 349/57 |
| 5,754,260 | * | 5/1998 | Ooi et al. | 349/10 |
| 5,933,203 | * | 8/1999 | Wu et al. | 349/35 |
| 5,942,154 | * | 8/1999 | Kim et al. | 252/199.01 |
| 5,949,390 | * | 9/1999 | Nomura et al. | 345/32 |
| 6,147,937 | * | 11/2000 | Arikawa et al. | 349/96 |

OTHER PUBLICATIONS

D.J. Broer, et al., Asia Display, pp. 735–738, "Reflective Cholesteric Polariser Improving The Light Yield of Back–And Side–Lighted Flat Panel Liquid Crystal Displays", 1995.

* cited by examiner

*Primary Examiner*—Richard Hjerpe
*Assistant Examiner*—Kimnhung Nguyen
(74) *Attorney, Agent, or Firm*—Oblon, Spivak, McClelland, Maier & Neustadt, P.C.

(57) ABSTRACT

A display device comprises a display element for displaying luminous images corresponding to color information on a second face of a screen; a polarization converting sheet which is disposed on the screen so that light irradiated from the screen enters and transmits selectively light having a first mode of polarization; and a liquid crystal color shutter which is disposed on the polarization converting sheet and transmits selectively light having the first mode of polarization so as to output as light of at least one color of primary colors corresponding to the color information. A display device may be an achromatic CRT. Thereby, a display device bright and large in its display screen can be realized with a simple constitution.

25 Claims, 26 Drawing Sheets

| | | LIQUID CRYSTAL CELL 401 | |
|---|---|---|---|
| | | +V | −V |
| LIQUID CRYSTAL CELL 402 | +V | BLUE | RED |
| | −V | GREEN | BLACK |

| 303 | | 304 + 305 | | 306 + 307 | |
|---|---|---|---|---|---|
| A | A' | A | A' | A | A' |
| A | – or G | Y | B or M | R or M | C |
| A | – or B | C | R or Y | G or Y | M |
| A | – or R | M | G or C | B or C | Y |
| A | – or B | M | G or Y | R or Y | C |
| A | – or G | C | R or M | B or M | Y |
| A | – or R | Y | B or C | G or C | M |

R : Red, G : Green, B : Blue, C : Cyan, M : Magenta, Y : Yellow
A : R+G+B (TOTALLY TRANSMISSIVE), – : NON-TRANSMISSIVE

DISPLAY DEVICE

BACKGROUND OF THE INVENTION

1. Field of the Invention

The present invention relates to a display device for displaying images. In particular, the present invention relates to a display device capable of displaying color images. In addition, the present invention relates to a display device having a large screen.

2. Description of the Related Art

Various types of display devices have been proposed. For instance, CRTs are being very widely used in such as television receivers, monitors of information processing device and the like. Further, in recent years, flat-panel displays such as liquid crystal displays (LCDs), plasma display panels (PDPs), field emission displays (FEDs) and the like are remarkable. Among them, liquid crystal displays have been used as the display devices in place of CRTs more frequently.

Now, in order to display color images, it is required that the three images, each of which consists of the light of each primary color, R(red), G(green), and B(blue) are synthesized. As a method of synthesizing images, a spatial division displaying method, in which each image is displayed by the 2-dimensionally arranged R, G, B dots (pixels), is known. Further, a time division display method, in which each image of R, G, B color is time sequentially displayed is also known, too. In generally used color CRTs and liquid crystal displays are based on the spacial division displaying method because R, G, B pixels are 2-dimensionally arranged on a screen.

The time division displaying can be realized by switching the colors of an over-all display screen synchronized with graded images to be displayed rapidly, using using an RGB color filter. In the time division displaying, it is required to display images with higher speed of 3 times or more compared with the case of spatial division displaying. However, since it is not required to decompose an image into R, G, B pixels, more high definition images can be displayed. As a method of switching colors of display screen, for instance, a method of mechanical rotation of a disc filter which is equally divided into 3 parts of different colors. As an electronic color switching method, a liquid crystal color shutter (LCCS) is proposed by Bos et al. (U.S. Pat. No. 5,387,920). The liquid crystal color shutter comprises two liquid crystal cells and color polarizers interposed before and behind them. By ON/OFF switching of the liquid crystal cells to control polarization of incident light, the wavelength of the light absorption by the polarizers are selected, so that RGB selectable displaying can be carried out. Advantages of the color liquid crystal shutter are that there is no mechanically moving component, and it has good space utility because the area of the display screen and that of the color shutter can be made equal.

Despite the aforementioned advantages of the liquid crystal color shutter, there is a problem that its transmittance of light is low due to use of polarizers. Due to the absorption of one component of polarized light, one half of the incident light is lost. Further, due to making chromatic color from achromatic light and switching of RGB displaying, one third of the incident light is lost. Therefore, even in the case of an ideal liquid crystal color shutter, the transmittance is about 16.7% (½ (transmission of polarizers)×⅓ (RGB displaying)=16.7%).

However, due to the light absorption in the transmissive axis of the polarizers and the light absorption of transparent electrodes being employed in the liquid crystal cell, further loss of light occurs. In reality, the transmittance of the liquid crystal color shutter is such low as about 5 to 8%. In order to secure screen brightness enough to display excellent images, the brightness of the emitting face of like a cathode ray tube is required to be increased. Therefore, several problems occur, for example, reduction of resolution power, deterioration of phosphor, increase of electric power consumption and so on.

Thus, a display device or the like using a conventional liquid crystal color shutter and an important problem that the brightness of the display screen is low due to the light absorption of the liquid crystal color shutter.

Displaying systems of a display device can be roughly divided into a direct-viewing type and a projection type. A display device of the direct-viewing type is that an observer views the displayed images directly. A projection type display device is that an observer views the enlarged images which are projected on a screen. The latter system is further divided into a front-projection type in which images are projected onto a reflective screen from the side of an observer and a rear-projection type in which images are projected onto a transmissive screen from behind the screen.

Such a conventional display device like a cathode ray tube or a liquid crystal display is difficult to make large its displaying screen area. For instance, in order to realize a large displaying area in the case of a CRT, either the CRT itself has to be made large or images displayed on a CRT is enlarged on a screen with the use of a projection optical system. However, making a CRT large involves lengthening of depth of the tube, and the weight is also more heavy. Further, in the case of the CRT, it needs to be evacuated inside the tube in which images are formed by irradiation of an electron beam. This also makes difficulty to enlarge the displaying area of a CRT.

To realize a large display screen area in a liquid crystal display device, in the case of the direct-view type, an array substrate itself is necessary to be made large. On the array substrate, many switching elements such as thin-film transistors and pixel electrodes are disposed in a matrix form. However, it is difficult to produce a very huge numbers of extremely fine semiconductors uniformly on the entire of the large substrate. Therefore, productivity of a liquid crystal display device becomes accordingly very low, resulting in a problem of increase of the cost. On the other hand, a plurality of array substrates can be tiled to realize a large displaying area. However, there is a problem that handling of the boundary of the tiled substrate is very difficult. Still further, it is difficult to obtain uniform displaying quality between the tiled plurality of array substrates. In the case of a PDP also, there is difficulty in manufacturing process caused by making large the screen.

A projection type of display device is easy to make large its screen area compared with various display device of direct-view type . However, it has less versatility compared with display device of direct-view type. For instance, illumination of the room is necessary to dark enough. Further, a projection type of display device is difficult to obtain sufficient brightness and contrast, resulting in a problem of worse displaying ability compared with the direct-view type display devices.

SUMMARY OF THE INVENTION

The present invention has been carried out to solve those problems described above.

The first object of the present invention is, with use of an LCCS, to provide display devices of color display type which are bright in their display screens.

Further, the second object of the present invention is to provide display devices which can display images with large size and high quality. Still further, the third object of the present invention is to provide display devices which can display images with large screen area and are light in their weight. Further, the fourth object of the present invention is to provide display devices with a simple structure, high productivity, and high quality images.

To solve such problems, the present invention employs the following constitution.

The first aspect of a display devices of the present invention is comprised of, displaying means for displaying luminous images on a screen having a first face and a second face opposite to the first face, and respective light images corresponding to color information; first selecting means to selectively pass a light having a first mode of polarization, the first selecting means being disposed on the second face of the screen so that a light emitted from the screen being introduced; and, second selecting means to selectively pass light having the first mode of polarization so that a light output has one of at least one of the primary colors corresponding to the color information, the second selecting means being disposed on the first selecting means.

In addition, a display devices of the present invention is comprised of, a means for displaying luminous images corresponding to color information on a screen; a first selecting means disposed on the screen so that light irradiated from the screen is incident thereon and transmitting selectively light possessing a first mode of polarization; and a second selecting means disposed on the first selecting means and transmitting selectively the light possessing the first mode of polarization so that at least one color of primary colors corresponding to the color information is emitted.

Further, displaying means of a self-emitting type for displaying graded images corresponding to the 3 primary colors by time division, a polarizing means formed on the light emitting face side of the displaying means and transmitting the respective graded image with the polarized component with the identical axis which is the transmissive axis of the polarizing means, and a color displaying means formed on the light emitting face side of the polarizing means and outputs the graded images corresponding to the 3 primary colors by inputting the graded images with the polarized component with the identical axis which is the transmissive axis of the polarizing means, can be also disposed.

The display means can employ one that displays the luminous images having achromatic gradations corresponding to the color information, or one that is capable of displaying the luminous images by field-sequential time division. For instance, CRTs, plasma display panels (PDPs), electro-luminescent elements and the like can be cited. These self-emitting types of displaying means are required to be not only a emitter (a light sources) but also be a displaying means capable of displaying the luminous images having gradations corresponding to at least the 3-primary colors of color by the time division. Further, these display means can display images of the RGB 3-primary colors with a frame frequency of 180 Hz or faster. Therefore, displaying with excellent image quality of low flicker level can be carried out.

In addition, when a CRT is employed as a display means, a display screen can be constituted with a single CRT or can be constituted by arranged a plurality of CRTs in order to constitute one continuous screen.

Further, a displaying means in which a beam of converged monochromatic light scans on the screen being provided phosphors, which will be described later, can be employed. That is, a display means may comprise at least one beam source irradiating a converged beam with essentially monochromatic, and the first face provided with at least one kind of phosphor emitting visible light when being irradiated by the incident light beam, and the second face a modulating means which modulates the intensity of the beam according to displayed signals containing the information of graduation, and a scanning means which scans the beam to the first face of the display means. One system of the beam source or a plurality of systems can be provided. A pair or a plurality of pairs of modulating means and the scanning means may be disposed for each system of beam source.

It is one of the remarkable character of the invention of display devices that a first selecting means converting the component of polarized light is disposed between a self-emitting type of display means, which is capable of displaying graded images, and a color displaying means for coloring the displayed image.

For the first selecting means, for instance, a polarizing element transmitting a linearly polarized light or an elliptically polarized light which is propagated to the direction in accordance with the normal axis of the screen can be employed. Further, for instance, a polarizing element transmitting one of the circularly polarized components of incident light which have the screw axis in the direction in accordance with the normal axis of the screen can be employed. The component of the polarized light being separated by the first selecting means is only needed to be independent each other in their polarization, any polarized component of the light can be employed, for instance, a linearly polarized light, a circularly polarized light, and an elliptically polarized light. When undesirable separation of the polarized light for the means related polarization is employed, in order to desired component polarized light at the light emitting face side, an appropriate phase modulating elements like a retardation film can be disposed.

Further, for the first selecting means, a non-absorptive type of polarizing element which reflects the component of polarized light except the transmittable one through the first selecting means can be preferably employed. With such a constitution, due to multiple reflection between the screen and the face of the first selecting means, the ratio of the light having the first component (mode) of polarization which is transmittable through the first selecting means can be increased in recurring manner.

The non-absorptive polarizing element is preferable that the separating operation of polarized light acts for the incident light in a normal direction to the incident surface. In this structure, it can be employed such as an array of prism-mirrors in which the reflective faces for separation of the polarized light are made of dielectric multiple layers and disposed in slanting manner to the direction of propagation of the incident light, an anisotropic dichroic mirror which can be obtained by stacking birefringent organic polymer films with each thickness of several 10 nm, or, a quarter-wave film disposed on the light emitting side and stacked cholesteric liquid crystal polymers having different screw pitches in order to occur the selectivity of circular polarized light. In the case of employing a liquid crystal cell using a cholesteric liquid crystal as a polarizing element, in general, it is required to use at least 3 layers of liquid crystal layers or more being different in their pitches each other. Thereby, with these polymer layers of the cholesteric liquid crystals, separation of the polarized light can be carried out over-all the visible wavelength region. However, for instance, it is described in "Asia Display" 95 (1995) pp.735 to 738, it is possible, with only one cholesteric liquid crystal layer, to invest the separation operation of the polarized light over all the visible wavelength region by varying continuously the pitch.

On the posterior side of such a first selecting means, a second selecting means is disposed in order to colorize and emit the transmitted light from the first selecting means. The second selecting means transmits the applicable color component of the light having the first polarized component which is transmitted the first selecting means, synchronized the color information. For instance, to provide such a colorizing means, color filters disposed on a rotating disc, each filter transmits one of the 3 primary colors can be cited. In the display device of the present invention, the second selecting means is preferable to employ a liquid crystal color shutter (LCCS) being capable of switching at least one of the 3 primary colors. In particular, an LCCS which is capable of switching the 3 color primaries of RGB synchronized with RGB images can be used preferably.

As will be described later, an LCCS is constituted of a plurality of chromatic polarizers and at least a couple of phase modulating elements. For instance, by controlling the state of a phase modulating element such as a liquid crystal cell from outside, plane of polarization of the incident light on the LCCS is rotated or modulated. Therefore, through selection of wavelength to be absorbed by colored polarizers, RGB displaying can be realized. As the phase modulating element, other than a liquid crystal cell, an electro-optic element such as PLZT, PLLZT, a Faraday element, which can modulate the phase of incident light by external field, can be used.

By adopting a first selecting means which uses a polarizing element, the transmittance of the incident light in the second selecting means can be improved. Undesirable component of the polarized light other than the first mode or component of polarization reflected by the first selecting means is depolarized by repeating multiple reflection at the emitting face of the screen, for instance, phosphor. Therefore, part of the incident light on the first selecting means can be transmitted recurrently from the first selecting means as the polarized light having the first polarized mode which is desirable component for other polarizing light elements. The remained undesirable component of the polarized light is reflected again. By such a repeated multiple reflection between the first selecting means and the screen, the luminous images emitted from the screen with gradation can possess the characteristics of the polarization. The second selecting means transmits only light having the first polarized mode, at the same time, selects its wavelength to pass in order to colorize. Therefore, by intervening the first selecting means between the screen and the second selecting means, the ratio of the intensity of the light transmitted from the second selecting means to the intensity of the light emitted from the screen can be remarkably improved. The reason is that the light absorbed by the polarizer at the light incidence side of the LCCS can be reduced.

Further, a screen, which is a displaying means, and the first selecting means are preferable to be disposed at close as much as possible. Thereby, occurrence of double image which is generated by scattering due to multiple reflection between the screen and the first selecting means, and deterioration of contrast can be avoided.

The second aspect of the display device of the present invention is comprised of, at least a beam source emits a light beam that is convergent and having substantially a monochromatic wavelength; a screen having a first face and a second face, the first face being formed of a matrix of at least three fluorescent materials, and the respective fluorescent materials emit light in different color when radiated by the light beam; modulating means to modulate a strength of the light beam corresponding to data signal; and scanning means to scan the light beam onto the first face of the screen.

In addition, the display device of the present invention is possible to comprise at least one beam source irradiating a converged beam of light essentially composed of a monochromatic light; a displaying means having a first face and a second face and being provided with at least one kind of phosphor, on the first face, which emits visible light when being irradiated by the beam of light, a modulating means for modulating the intensity of the beam of light in response to displaying signals with the color information, and a scanning means scanning the beam of light on the first face of the displaying means.

On the second face side of the screen, the aforementioned first selecting means or the second selecting means may be disposed. It means that the a first selecting means disposed on the second face so that the light irradiated from the phosphor can enter the second face side of the screen, and the light having the first polarized mode can be transmitted selectively, and a second selecting means disposed on the first selecting means so that the light having the first polarized mode can be transmitted selectively and colorized with at least one color of the primary colors corresponding to the color information. The second selecting means transmits chromatic light having the first mode of polarization synchronized with the color information. Therefore, color images can be displayed.

The third aspect of the display device of the present invention is comprised of, at least a beam source emits a light beam that is convergent and having substantially a monochromatic wavelength; a screen having a first face and a second face, the first face being formed of a matrix of at least three fluorescent materials, and the respective fluorescent materials emit light in different color when radiated by the light beam; modulating means to modulate a strength of the light beam corresponding to data signal; and, scanning means to scan the light beam onto the first face of the screen.

Further, the display device of the present invention is also possible to be comprised of, at least one beam source irradiating a converged beam of light essentially consisting of monochromatic light; a display means having a first face and a second face, and disposed on the first face at least 3 kinds of phosphors in matrix which emit in different colors each other when being irradiated by the beam of light; a modulating means modulating the intensity of the beam of light in response to the display signal including the color information; and a scanning means scanning the beam of light on the first face of the display means.

The beam source, the modulating means, and the scanning means can be disposed in a plurality of systems according to colors of emitted light from the phosphors, and each beam of light requires selective scanning for only one kind of the phosphors.

Further, it is preferable that the wavelength of the beam of light is selected to maximize the quantum efficiency of the phosphors.

In the display device of the second aspect and the third aspect of the present invention, a convergent and essentially monochromatic beam of light is employed. Here, the essentially monochromatic light also means the light distributed in a narrow wavelength region. Further, the beam source is preferred to irradiate an essentially continuous wave.

In addition, a plurality of beam sources may be disposed, and the modulating means and the scanning means may be disposed in a plurality of systems to the respective beam sources.

For instance, when color images are displayed with provided 3 systems of the beam sources corresponding to 3 primary colors and scanning optical systems are disposed for respective beam sources, the frame rate of the display device can be reduced to one third of that in the case of using a single system of the beam source.

Further, on the second face side of the screen which is opposite to the scanning means, a colorizing means for the emitted light from the phosphor layer can be employed. Such as a coloriziing means, the aforementioned second selecting means (for instance, the LCCS), the color filter and the like can be cited.

The second selecting means can be divided into a plurality of several regions in order to be driven independently. It means that the second selecting means can be divided to the several regions, and each region can transmit and colorize the incident light independently at the same time. In this case, the plurality of beams of light draw the respective RGB images simultaneously on each different region of the screen. Color images can be displayed provided that the displaying color of the applied displaying region of the LCCS is switched in accordance with the scanned RGB raster image.

Namely, the displaying method of the displaying device of the present invention is the 2 dimensional scanning of the converged ray with a narrow band to the screen formed a layer of phosphors, the intensity of the ray is modulated in response to the displaying signal.

The beam source can be employed which emits light with the wavelength of about 300 to about 450 nm. In such a region of wavelength, even if glasses are disposed in its light path, almost all of the light can be transmitted the path. Using such as a beam source, even if an optical system made of glass is disposed between the beam source and the screen, the absorption and scattering of the light can be reduced.

For instance, lasers, LEDs (light-emitting diode) and the like can be cited as the beam source, and it is preferable the wavelength of the light emitted from their light sources are about 300 to 450 nm, which belongs to near ultraviolet blue or blue wavelength. As the laser, a semiconductor laser may be used.

Further, as the beam source, either coherent light or quasi-coherent light is preferably employed. In any way, the light which can be transmitted through optical glasses and can be converged on the screen can be employed. The beam source can be employed that the emitted light transmitted the glass conformed to for instance "BK-7".

By using the light containing much coherent component, a diffraction grating is preferable as a modulator from the point of efficiency. Further, it improves the convergence on the screen. Therefore, the displaying quality can be improved.

Further, as the light source, an SHG or a THG due to combination of such as a He-Ne laser, a He-Cd laser, a Nd:YAG laser, Ar ion laser, and a non-linear optical crystals such as KDP($KH_2PO_4$), KD*P($KD_2PO_4$), ADP ($NH_4H_2PO_4$), CDA($CsH_2AsO_4$), CD*A($CsD_2AsO_4$), RDP ($RbH_2PO_4$), RDA($RbH_2AsO_4$), $BeSO_4.4H_2O$, $LiClO_4.3H_2O$, $CO(NH_2)_2$, $LiIO_3$, $LiNbO_3$, $Ag_3AsS_3$, $Ag_3SbS_3$, $AgGaS_2$, $AgGaSe_2$, $CdGeAs_2$, $ZnGeP_2$, GaSe, CdSe, HgS, Se, Te, KTP($KTiOPO_4$), $Ba_2NaNb_5O_{15}$, $KNbO_3$, MNA($C_6H_4(NH_2)(NO_2)$); semiconductor lasers such as InGaN system, GaN system, SiC system, ZnCdSe system; or an LED (light emitting diode), can be employed.

Arbitrary number of the beam source can be employed. Particularly, in the case of displaying chromatic images, employing 3 channels of the beam source corresponding to 3 primaries is preferable.

Further, the light from a plurality of beam sources may be synthesized with optical systems such as lenses, prisms, optical fibers and the like. By employing this structure, irrespective of the number of the beam sources, even if the intensity of the light output per one light source is insufficient compared with the necessary intensity for each channel, the appropriate light intensity can be obtained.

A beam of light is modulated in its intensity in response to signal to be displayed. Intensity modulation can be carried out about the beam of light emitted from the beam source. Further, the quantity of irradiation from the beam source can be modulated for making the graded image.

In the case of controlling the quantity of irradiation from the beam source, the signal is applied to the beam source by modulation of voltage or current with level modulation or pulse modulation in time division.

In addition, in the case of modulating the intensity of the beam irradiated from the beam source a light shutter which is interposed in the light path can be employed. In this case, a converged light with a single mode can be preferably used for each channel as a beam.

As the light shutter, for instance, a mechanical shutter, an acousto-optical element in which a piezoelectric element is attached to a container of liquid medium, a non-linear optical crystal such as KDP, PLZT, $LiNbO_3$ and the like or an electro-optical element using a liquid crystal cell is appropriated. Further, as a method of modulation of intensity in this case, a time division method like a controlling the time period blocking the light path, a method using diffraction grating and a slit for diffractive light modulator, a method using a phase modulation elements like a rotator or a birefringent medium combined with polarizers, can be employed.

In the display device of the present invention, displaying image is carried out the layer of phosphors, which emits a visible light converting the wavelength of the incident light, disposed on the screen is irradiated 2-dimensionally by the beam from the beam source as a raster of IV. The phosphor layer may be disposed on a transparent substrate such as a glass or an acrylic resin.

The phosphor layer can be uniformly disposed over the whole screen, or can be disposed in matrix to form pixel arrays. In the case the phosphor layer is disposed in an uniform way over the whole screen, an area of the phosphor layer emitting visible light by an irradiation of beam is a pixel unit.

As a two dimensional scanning means, for instance, a biaxial scanning mirror for X-Y directions, a polygon mirror can be cited.

In this case, the scanning is carried out so that the scanning frequency of the direction of X-axis is commensurate with a horizontal frequency of image, and that of the direction of Y-axis is commensurate with a vertical frequency.

The representative vertical frequency is 60 Hz for achromatic displaying. In the case of color displaying, the vertical frequency requires 180 Hz for the displaying device in this invention using a single beam source. In order to reduce the vertical frequency, 3 channels of beam sources equivalent to the channels of RGB signals can be employed and driven with a different phase each other. Using this driving method, the vertical frequency of 60 Hz can be realized.

The phosphor emits a visible light when it is irradiated by the beam, which is scanned on the screen from the beam source by a scanning means such as an X-Y scan mirror. Since the beam is intensity modulated in response to displaying signals, an image is drawn on the screen.

The wavelength region of light emitted form phosphor is necessary to be from about 400 to about 800 nm. Phosphors emitting light within the aforementioned wavelength are the follows.

As phosphors emitting white light, for instance, (Zn,Cd)S:Ag,Au,Al, $3Ca_3(PO_4)_2.Ca(F,Cl)_2:Sb^{3+}$, $Mn^{2+}$, $Y_2SiO_5:Tb^{3+}$ can be cited.

As phosphors mainly emitting in red color light, for instance, $Y_2O_2S:Eu^{3+}$, $Zn_3(PO_4)_2:Mn^{2+}$, (Zn,Cd)S:Ag, $YVO_4:Eu^{3+}$, $Y_2O_3:Eu^{3+}$, $(Sr,Mg)_3(PO_4)_2:Sn^{2+}$, $LiAlO_2:Fe^{3+}$, $YVO_4:Dy^{3+}$, $6MgO\ .As_2O_5:Mn^{4+}$, $3.5MgO.0.5MgF_2.GeO_2:Mn^{4+}$ can be cited.

As phosphors mainly emitting in green color light, for instance, ZnS:Cu, Al, ZnS:Cu,Au,Al, $Zn_2SiO_4:Mn^{2+}$, (Zn, Cd)S:Ag, (Zn,Cd)S:Cu,Al, $(Ba,Ca,Mg)_{10}(PO_4)_6Cl_2:Eu^{2+}$, $2SrO.0.84P_2O_5.0.16B_2O_3:Eu^{2+}$, $LaPO_4:Ce^{3+}$, $Tb^{3+}$, $Sr_2Si_3O_8.2SrCl_2:Eu^{2+}$, $Y_2SiO_5:Ce^{3+}$, $Tb^{3+}$, $CeMgAl_{11}O_{19}:Tb^{3+}$, $Sr_4Al_{14}O_{25}:Eu^{2+}$, $GdMgB_5O_{10}:Ce^{3+}$, $Tb^{3+}$, $MgGa_2O_4:Mn^{2+}$, $Y_3Al_5O_{12}:Ce^{3+}$(YAG:$Ce^{3+}$) can be cited.

As phosphors mainly emitting in blue color light, for instance, ZnS:Ag, $(Sr,M)_{10}(PO_4)_6Cl_2:Eu^{2+}$(M=0 to 0.1Ca), $Sr_2P_2O_7:Eu^{2+}$, $(Sr, Mg)_2P_2O_7:Eu^{2+}$, $Sr_3(PO_4)_2:Eu^{2+}$, $BaMgSi_2O_8:Eu^{2+}$, (Sr, Ba) $Al_2Si_2O_8:Eu^{2+}$, $YVO_4$, $Ba_{0.87}Mg_{2.0}Al_2O_3/_{(2Z+3)}:Eu_{0.13}{}^{2+}$(z=14.0, 16.0, 25.0) can be cited.

As a phosphor emitting mainly in blue/green color light, for instance, $Ba_{0.8}Mg_{2-X}Al_{16}O_{27}:Eu^{2+}$, $Mn_X{}^{2+}$(x=0.07 to 0.4) can be cited.

Now, the phosphors are not restricted to those illustrated above, but can be selected according to demands.

Further, the phosphors vary in their quantum efficiencies depending on the wavelength regions of the irradiated beam. Therefore, the phosphors can be selected from ones that are efficient in their efficiencies according to the wavelength of the beam of light emission. In addition, the wavelength of the beam irradiated from the beam source may be selected according to the wavelength region where the phosphors are efficient in their emission of light.

On the side of the beam incidence of the phosphor layer, a dichroic mirror and the like which transmit the incident beam and reflect the visible light component emitted from the phosphor, can be preferably disposed. With such a constitution, light emitted from the phosphor can be outputted with high efficiency to the second face side of the screen. This effect contributes the enhancement of brightness of displayed image.

To display color images with a display device of the present invention, there are two displaying methods. The one is displaying the image which is directly colorized by the chromatic light emitted from the phosphors disposed on the screen. The other is displaying the image which is colorized by the partial absorption of achromatic light emitted from phosphors at a colorizing means such as a color filter including LCCS.

To display color images with chromatic light emitted from phosphors disposed on the screen, the 3 kinds of phosphors emitting each chromatic light with 3 primaries are necessary to be disposed on the screen, for instance. In this way, a phosphor mainly emitting R(red) colored light, a phosphor mainly emitting G(green) colored light, and a phosphor mainly emitting B(blue) colored light are arranged on the screen in matrix, and the converged beam, which is modulated its intensity according to the signal data, is irradiated on these phosphors.

By adopting of such a constitution, the color images can be displayed with the phosphor of each color as a pixel unit. Incidentally, the modulation of the intensity of the beam is preferable to be carried out so as to compensate for imbalance between intensities of lights emitted from the phosphors being used for each color or that of the non-linearity of the gradation of the emitted light.

On the other hand, in th e constitution in which color images are displayed by colorizing the achromatic light emitted from the phosphor with a coloring means such as color filters, only one kind of phosphor emitting achromatic light is necessary to be disposed on the screen. The phosphor can be disposed in matrix for each pixel, or can be disposed without being separated. When the latter constitution is adopted, the productivity of the display device can be further improved.

On the second side of the screen opposite to the side of beam incidence, a colorizing means such as an RGB color filter or an LCCS is disposed. Thereby, color images can be displayed. That is, an RGB color filter is disposed on the screen thereon the phosphor is disposed, the phosphor in the front of the respective color filters is irradiated with the intensity modulated beam by scanning. The part of the screen formed of the phosphor layer corresponding to R pixels, G pixels, B pixels on the screen are irradiated with the beams modulated its intensity in response to respective data signal of RGB channel. By making the light emitted from these areas pass through the color filters of RGB respectively, color images can be displayed.

In this case, by disposing each phosphors emitting light with one of the primary color under the color filter layer in conformity with the to positions of each color filter, the highest efficiency of emission can be obtained. A process with a high temperature is not necessary for making RGB color filters. Therefore, a dye type color filter can be used in addition to the conventional pigment type color filter.

In the following, a principle for displaying color images with an LCCS will be described.

The LCCS is a color shutter constituted of two liquid crystal cells and color polarizers. By controlling the voltage supplying to the liquid crystal cell, the wavelength of the transmitted light can be selected. For instance, the beam modulated its intensity in response to signals of RGB channels is irradiated on the parts of the screen. Then, the light emitted from the irradiated area of phosphor is transmitted the LCCS displaying one of the primary colors switched in order, thereby color images can be displayed.

Here, a liquid crystal cell is one in which a liquid crystal layer is sandwiched by two substitutes formed a layer of transparent electrodes. According to the supplied voltage which is inserted to the liquid crystal layer between the electrodes, the intensity or the polarization of the incident light to the liquid crystal layer can be modulated.

As a liquid crystal cell, a pi-cell in which a nematic liquid crystal is aligned 180° twisted, a ferroelectric liquid crystal, an anti-ferroelectric liquid crystal can be employed. A fast response time (for instance, possible to be switched in about 2 ms or less) and a wide viewing angle (more than about 90 degree) are preferable characteristics for the liquid crystal cell.

A principle of switching colors of the transmitted light from the LCCS is the modulation of the transmittance of the incident light due to the modulation of the birefringence of the liquid crystal layer. Retardation of the liquid crystal cell is made $\lambda/2$ ($\lambda$: wavelength) and its fast axis is disposed to be positioned in 45° direction to transmissible axis of a color polarizer. An appropriate gap of a liquid crystal cell of which retardation is $\lambda/2$ is about 4 to 5 $\mu$m for a pi-cell. An appropriate gap for the case of a ferroelectric liquid crystal cell, an anti-ferroelectric liquid crystal cell is about 1.5 $\mu$m to 2.5 $\mu$m. In a color polarizer, two pairs of the color polarizers being in complementary color relation each other are set to be orthogonal with respect to their transmitting axes, a sheet of achromatic polarizer are used in combination.

By controlling ON/OFF of the voltage to be supplied on a liquid crystal cell, selective displaying of four colors can be carried out. The displayed colors are preferably combined to be able to display three primary colors of red, green, blue, and black display.

To drive a liquid crystal cell in the LCCS, the liquid crystal cell is driven so that the RGB colors are switched according to the RGB of the beams. In particular, when color displaying is carried out with a beam source of 3 channels driven at 3 phase, 60 Hz, it is preferable to separate the transparent electrode of the LCCS into a plurality of regions, and to repeat the operation of scanning images with the respective beam sources. For instance, by designing in such a manner that an upper portion of a screen of the LCCS is assigned to R display, a central portion to G display, and a lower portion assigned to B display, each region can be scanned with the corresponding beam sources. With such a constitution, without raising scanning frequency (frame rate), proper color images can be displayed.

Controls of supplying voltage for a liquid crystal cell will be described. In the case of a pi-cell, the wave form of supplying voltage to a liquid crystal cell is varied symmetrical with respect to 0V for ON/OFF switching. When a ferroelectric liquid crystal or an anti-ferroelectric liquid crystal is driven, for instance, ON/OFF switching is carried out by supplying a positive direct voltage for an ON state, and by supplying a negative direct voltage for an OFF state. In this case, four states, that is, all of RGB and black are preferable to be switched with an equivalent period. The reason is that, to avoid an image sticking of a liquid crystal, an alternating voltage is required to be supplied. In particular, it is preferable the black displaying period is divided into three equivalent periods, and inserted in switching periods of RGB display. Thereby, excellent displaying can be obtained without displaying interruptions.

Further, in order to increase the transmittance of the LCCS, it is preferred to dispose a first selecting means at least on one side of the phosphor layer, such as a polarization converting sheet which converts the unpolarized light emitted from phosphor into desired polarization.

A polarization converting sheet transmits only a predetermined mode of polarized light, reflects other mode of polarized light. Such a polarization converting sheet is disposed so as to transmit the only polarized light of which polarized light transmissible axis coincident with that of a light incident side of the LCCS and so as to reflect the other component of the polarized light. The reflected component of the polarized light is depolarized through repetition of multiple-scattering at a surface of the screen (for instance, surface of phosphor, bulk of phosphor, or a surface of a substrate thereon phosphor is disposed). Therefore, the component of the polarized light transmitted the polarization converting sheet is increased in a recurring manner. By disposing the polarization converting sheet, a light component absorbed by a polarizer disposed on the incident side of the LCCS can be reduced. Therefore, the transmittance of incident light to the LCCS can be enhanced, thereby bright and high quality displaying can be materialized.

As a member of constituting a polarization converting sheet, an anisotropic dichroic mirror obtained by stacking an organic polymer possessing birefringent characteristics with thickness of about several tens nanometer can be employed. Further, using the selectivity of circularly polarized light of cholesteric liquid crystal, the cholesteric liquid crystal with a quarter wave-film formed at the side of light emission can be employed provided that the cholesteric liquid crystal is multi-layer in different spiral pitch or a least a mono-layer with varied pitch.

Irrespective of either constitution is adopted, in order to avoid multiplicity of images due to multiple scattering, disposition of a polarization converting sheet on the phosphor surface is preferable.

Further, when such a polarization converting sheet is disposed, there is a preferable stacking order for polarizers of the LCCS. In order to improve light transmittance of the second selecting means, it is preferable to dispose an achromatic polarizer on the light incident side, and to dispose a blue transmitting polarizer on the light outputting side. The reason is that a blue polarizer can reduce, contrast deterioration most effectively due to ambient light among the color polarizers.

In a display device of the present invention, an incident angle of light to the phosphor layer through scanning by a scanning means is different between a central portion and an edge portion of a screen. If a diameter of a beam is smaller than a pixel size of the image drawn, the incident angle of the light to the screen does not matter. Further, when the intensity of the light emitted from the phosphor varies due to the incident angle, the intensity of the beam can be modulated with a modulating means so as to compensate for this difference.

On the light incident side of the phosphor layer, an adjusting means of adjusting an incident angle such as a diffraction grating, a holographic optical element (HOE) may be disposed. The light modulated in its intensity can be entered with a normal direction of the screen adopting such a constitution. That is, according to thickness of the phosphor layer, property of the phosphors, or the size of the screen, and the angle of the incident light can be optimized.

Through adoption of such a constitution, irrespective of the relative position between the scanning means and the unit pixel area, the beam modulated in its intensity can enter the phosphor layer efficiently and with a uniform angle of incidence.

Further, the scanning means and the screen can be disposed with a s mall distance. To make large a display screen in a CRT, the depth of CRT its thickness is required to be increased. According to the present invention, a display device with large size of the display screen and thin depth of the device can be realized.

DETAILED DESCRIPTION OF THE PREFERRED EMBODIMENTS

In the following, a display device of the present invention will be described in more detail. However, the constitution of the display devices of the present invention, which will be described with illustrations in the following embodiments, is not restricted only to them. Further, illustrated constitutions of respective portions can be employed in various combinations.

(Embodiment 1)

Figure 1:
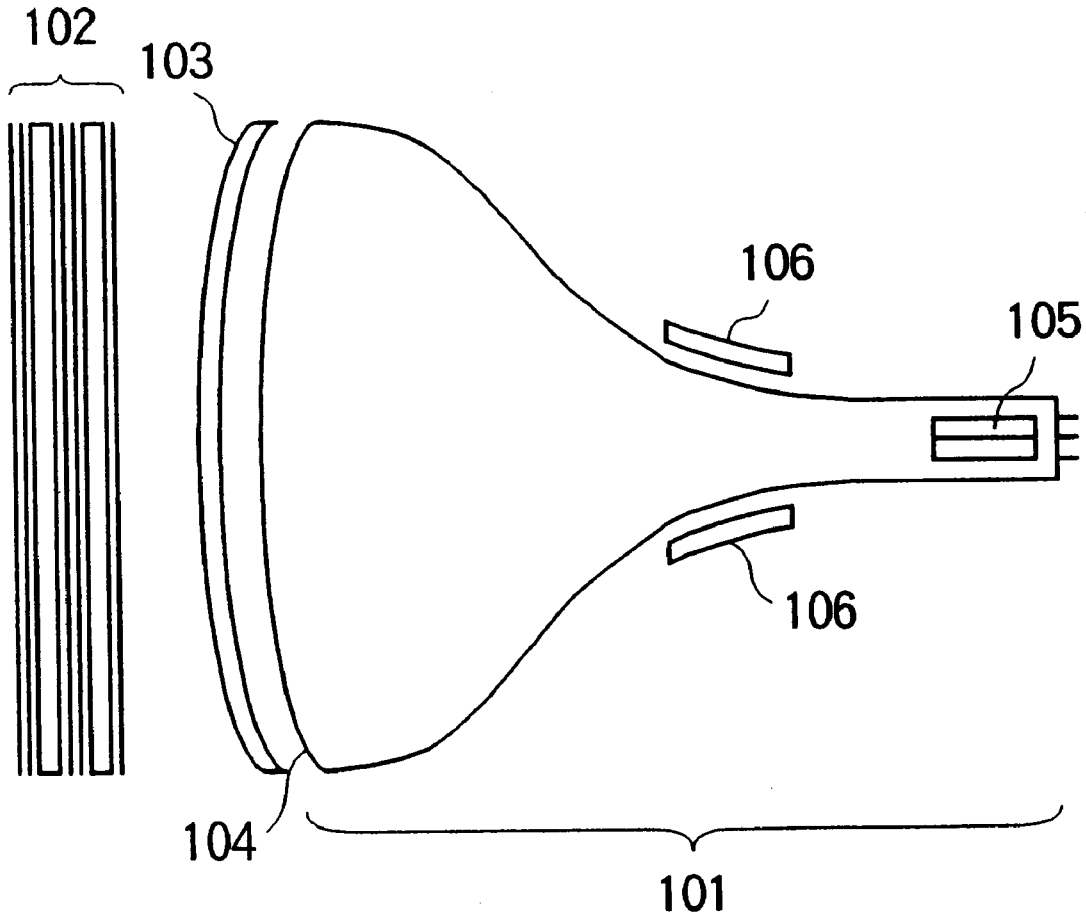
FIG. 1 is a diagram diagrammatically showing an example of a constitution of a display device of the present invention.

FIG. 1 is a diagram showing schematically a constitution of a display device of the present invention. A CRT 101 which is a means of displaying self-emitting type luminous images is ordinarily an achromatic CRT. This CRT, though not shown in the figure, through parallel-serial transformation, rate transformation of signals of color images of RGB, can display luminous images corresponding to RGB in time division manner with 3 times the ordinary frame cycle, 180 Hz.

An LCCS 102, which is a second selecting means for carrying out color display, is a liquid crystal color shutter therein two sheets of liquid crystal cells and color polarizers are combined. An LCCS 102, by use of three ways of four ways of combinations of ON/OFF states of each liquid crystal cell, can select wavelength of transmitted light to display RGB colors.

Between a screen glass of the CRT 101 and the LCCS 102, a polarization converting element 103, which is a first selecting means, is interposed. An achromatic luminous image emitted from the screen glass of the CRT 101 transmits a polarization converting element 103, the LCCS 102, to be color displayed. The polarization converting element 103 makes an intimate contact with a front face (a second face) of the screen glass 104 of the CRT 101. A material which consists the polarization converting element 103 is a polymer film having optical anisotropy. The polarization converting element 103 and the screen glass 104 are adhered with a transparent adhesive which is matched in its refractive index therewith not so as to generate an interfacial reflection. Reference numerals 105 and 106 are an electron gun, deflection yokes, respectively.

Figure 2:
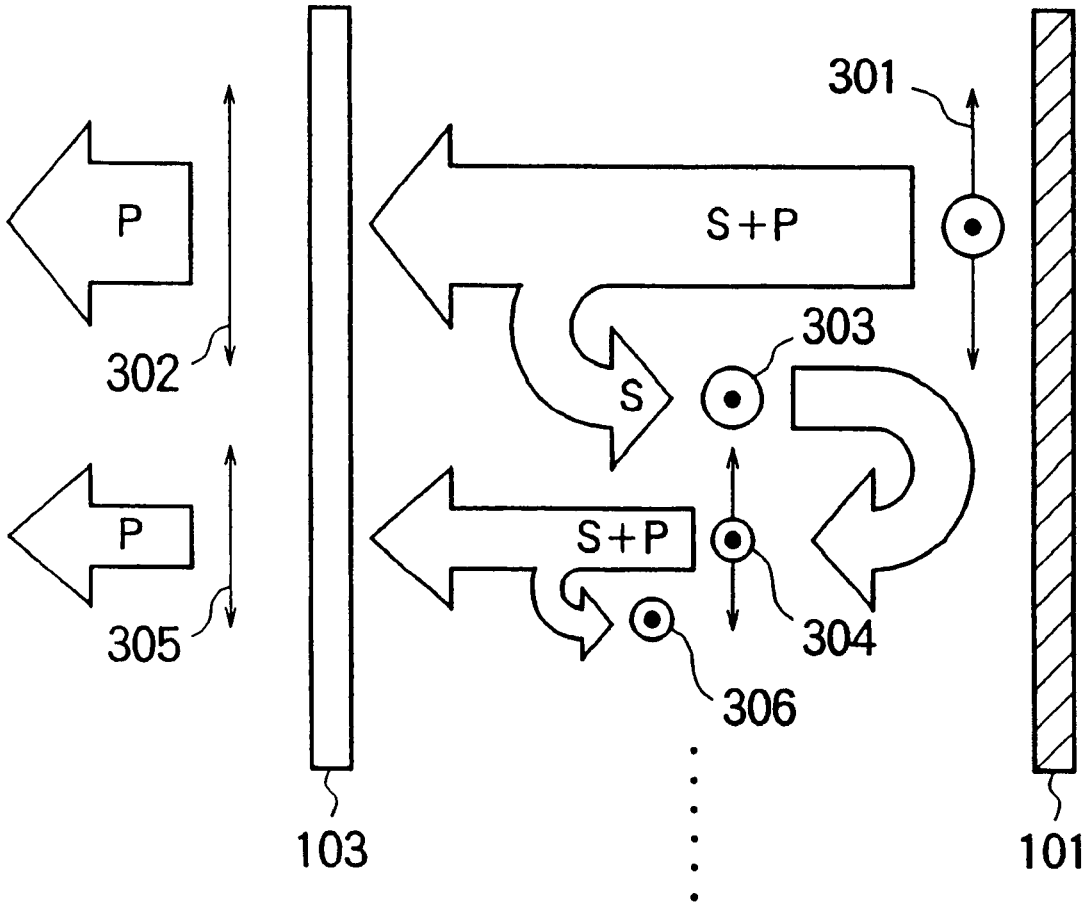
FIG. 2 is a diagram for explaining a principle of a polarization converting sheet.

FIG. 2 is a diagram for explaining a principle of a polarization converting sheet 103.

Inside a screen glass of a CRT (a first face), a phosphor 101 is disposed. Light 301 emitted from the phosphor 101 is not in a polarized state. Therefore, the light 301 contains evenly a linearly polarized component (P) vibrating in parallel with a plane of the paper and a linearly polarized component (S) vibrating in a vertical direction with respect to the plane of the paper.

Such the light 301 emitted from the phosphor is discriminated with use of a polarization converting sheet 103. That is, among the emitted light 301, the polarized component P, 302, which is identical in its direction with that of a transmissive axis of a polarizer 403 of an incident side of an LCCS 102, transmits the polarization converting sheet 103. At the same time, the other component of the polarized light S, 303 is returned to the phosphor side due to reflection by the polarization converting sheet 103. The reflected polarized component S, 303, through further reflection due to the surface, the inside, the rear surface of the phosphor 101, enters recurrently into the polarization converting sheet 103. Main reflection due to the phosphor is diffuse reflection due to scattering. Therefore, the polarized light is depolarized due to this diffuse reflection, the light 304 entering again into the polarization converting sheet 103 is accordingly in a non-polarized state. This light, as identical as the above, is separated into a transmitting component 305 and a reflecting component 306 by the polarization converting sheet 103.

Through repetition of such a multiple reflection, the non-polarized light emitted from the phosphor 101 can be converted into the polarized light. Therefore, utility efficiency of light can be improved, in principle, 100% of light (50% in principle when there is no polarization converting sheet 103) can be utilized. Therefore, quality of display can be improved.

Figure 3A:
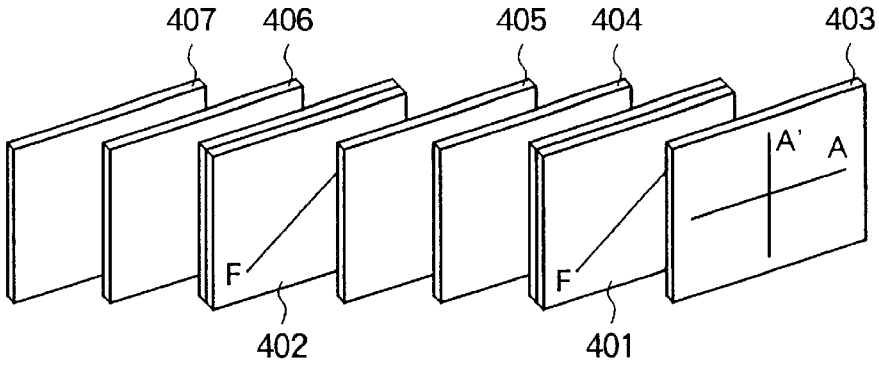
FIG. 3A, FIG. 3B, and FIG. 3C are diagrams for explaining a constitution of an LCCS and light transmittance characteristics.
Figure 3B:
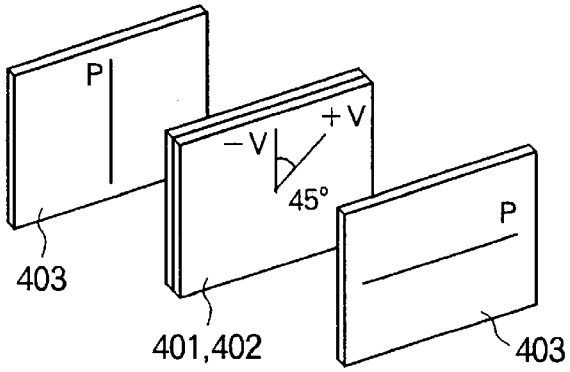
Figure 3C:
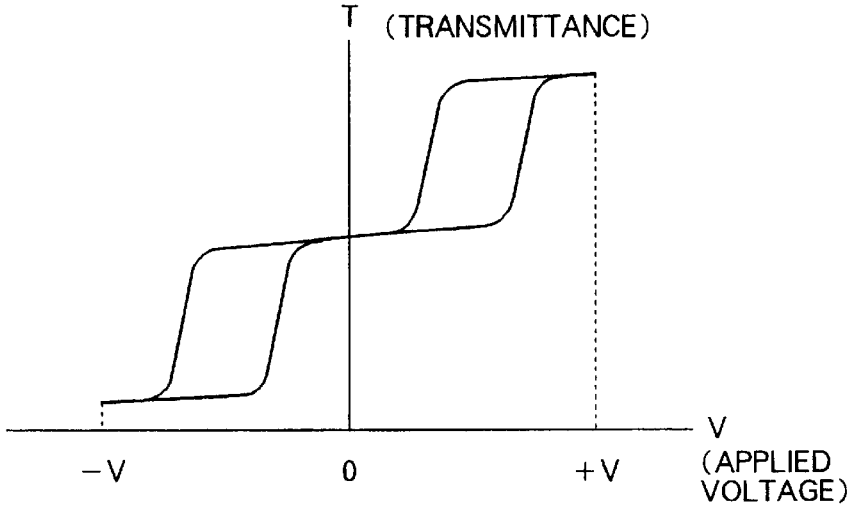

FIG. 3A, FIG. 3B, and FIG. 3C are diagrams for explaining an LCCS 102. FIG. 3A, and FIG. 3B are showing diagrammatically a constitution of an LCCS, FIG. 3C shows a transmittance characteristics of a liquid crystal cell constituting an LCCS.

An LCCS 102 comprises anti-ferroelectric liquid crystal cells 401, 402 of birefringence $\Delta n=0.125$, about 2 $\mu$m of cell gap. These liquid crystal cells 401, 402 and polarizers 403, 404, 405, 406, 407 are combined as shown in the figure.

A polarizer 403 on the light incident side of the LCCS is achromatic. The other polarizers 404, 405, 406, 407 are color polarizers. Color of each polarizer is cyan (polarizer 404), red (polarizer 405), yellow (polarizer 406), blue (polarizer 407), in this order. In particular, the polarizer 403 of the light incident side is an important film of which the transmissive axis of the polarized light is identical with that of the polarization converting element 103, since the noise contained in achromatic images which is irradiated from the polarization converting element 103 and aligned in its polarized light transmissive axis is removed, effect such as contrast enhancement, S/N ratio enhancement of the final colored images which the observer recognizes can be attained.

FIG. 3C is a diagram for explaining transmittance characteristics of liquid crystal cells 401, 402.

The liquid crystal cells 401, 402 are disposed in such a manner that the fast axis F of transmitted light intersect each other with 45° when voltage of +V, −V are applied to the liquid crystal layer.

Now, we will consider a case where the polarized light transmitting axes P of the polarizers 403 are disposed orthogonal each other (FIG. 3B). Voltage-transmittance characteristics becomes a diagram shown in FIG. 3C, through input of direct voltage of +V/−V, switching between dark screen and bright screen is carried out. That is, through input of direct voltage of +V/−V, 90°/0° switching of polarization axis of the incident light can be carried out.

Figures 4A, 4B:
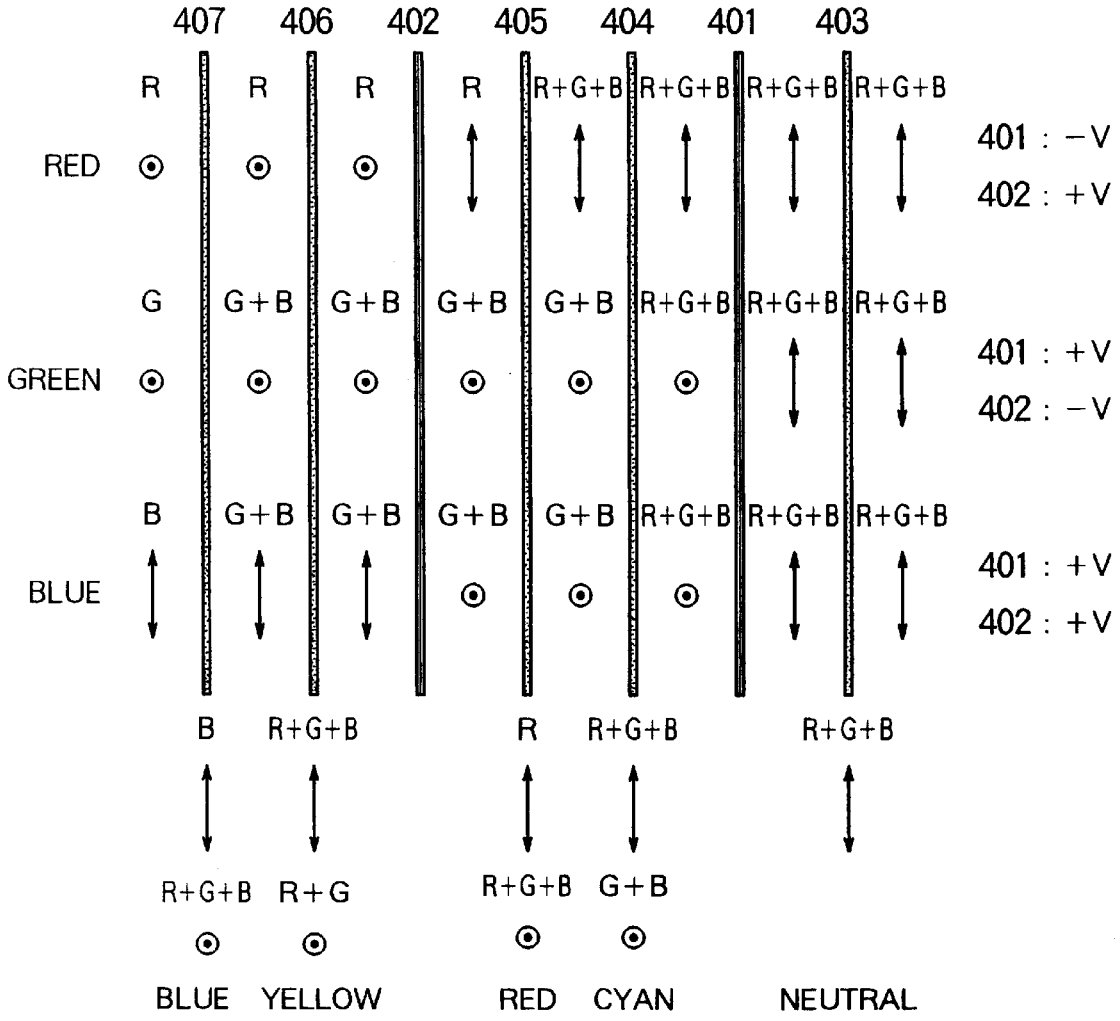
FIG. 4A is a diagram for explaining correspondency between input voltage to a liquid crystal cell of an LCCS and colors to be displayed.
FIG. 4B is a diagram showing correspondency between switching of input voltage to a liquid crystal cell of an LCCS illustrated in FIG. 4A and colors to be displayed.

FIG. 4A is a diagram for explaining correspondency between input voltage to a liquid crystal cell of an LCCS and colors to be displayed.

Respective transmitting characteristics of the polarized light of polarizers 403, 404, 405, 406, 407 are shown at the lower side of FIG. 4A.

For instance, direction of the transmissive axis of the light of an achromatic polarizer 403 on the light incident side is in parallel direction with respect to the plane of paper.

On the other hand, for a blue polarizer 407 at the light outputting side, the component of the polarized light vertical to the plane of paper is transmitted (transmissive axis). Whereas the polarized light in parallel with the plane of paper transmits only blue component, the other components of RG are absorbed (absorption axis).

Now, we will consider a case where, by disposing such polarizers as shown in FIG. 4A, voltage of −V[V] is inputted to a liquid crystal cell 401, voltage of +V[V] to 402.

The liquid crystal cell 401 thereto −V[V] is inputted outputs the incident polarized light as it is without rotating. Therefore, the linearly polarized light which transmitted the achromatic polarizer 403 is not absorbed by a cyan polarizer 404. Therefore, G component and B component are absorbed when transmitting a red polarizer 405. Though the transmitted R component is rotated by 90° in its plane of polarization by the liquid crystal cell 402, it is absorbed during transmission of neither an yellow polarizer 406 nor a blue polarizer 407. Therefore, the R component of the polarized light which transmitted the red polarizer 405 is outputted as it is, to be red display.

Thus, an LCCS, by switching the voltage to be inputted to the liquid crystal layers of the liquid crystal cells 401, 402 between +V and −V, can transmit selectively only the polarized light having a desired color component.

FIG. 4B is a diagram showing correspondency, in an LCCS of a constitution illustrated in FIG. 4A, between switching of input voltage to the liquid crystal cells 401, 402 and colors to be displayed. For instance, since a liquid crystal cell 401 thereto −V is inputted outputs the incident polarized light as it is without rotating, the linearly polarized light transmitted an achromatic polarizer 403 is not absorbed by a cyan polarizer 404, GB components are absorbed during transmission of a red polarizer 405. The transmitted R component is rotated 90° in its plane of polarization by the liquid crystal cell 402 thereto +V is inputted, the R component of the polarized light is outputted as it is without being absorbed during transmission of either an yellow polarizer 406 or a blue polarizer 407, to display red.

Figures 5, 6:
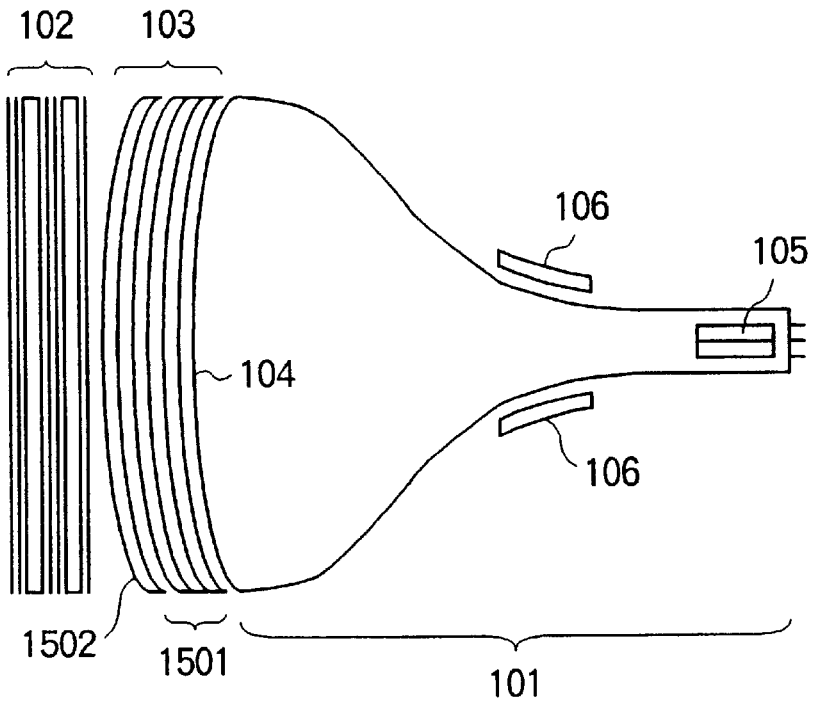
FIG. 5 is a diagram showing possible combinations of polarizers of an LCCS in the display device of the present invention.
FIG. 6 is a diagram diagrammatically showing another example of a constitution of a display device of the present invention.

FIG. 5 is a diagram showing possible combinations of the polarizers of the LCCS in a display device of the present invention. In this table, rows of polarizers 404 and 405, polarizers 406 and 407 are interchangeable, but it is needless to say that the polarizer 403 is required to be disposed at the light incident side, the transmissive axis of the polarized light A of the polarizer 403 is required to be disposed to coincide with the transmissive axis of the polarized light of the polarization converting element. Further, the polarizer 407 of the most foreground to the observing side of the display screen and facing the light outputting face is preferable to be a blue polarizer capable of reducing most reflection of the ambient light. With the aforementioned constitution, there is an effect that a high definition display device of about 2 times more efficient optically, that is, 2 times more bright than the conventional display device can be provided.

(Embodiment 2)

FIG. 6 is a diagram showing diagrammatically another example of a constitution of a display device of the present invention. In this example, for the polarization converting element 103, a layer of a cholesteric liquid crystal polymer 1501 and a quarter-wave film 1502 are disposed. In the following explanation, the identical portions with the embodiment 1 will be explained omitted. The layer of the cholesteric liquid crystal polymer 1501, as identical as the embodiment 1, may be stuck to the screen glass 104 as a film. Further, it can be also formed integrally on the screen glass with the following method. For this, first, a cholesteric liquid crystal monomer cured by ultra-violet light and an initiator for hardening by ultra-violet light are dissolved in a volatile solvent such as toluene with a predetermined mixing ratio. Then, it is coated on the screen glass with a spinner. After volatilization of the solvent, orientation treatment is carried out, then it is polymerized under irradiation of ultra-violet light. By repeating a series of these operations necessary times, a polarization converting element can be formed integrally on the screen glass. Finally, a quarter-wave film, which serves as a protecting film at the same time, may be stuck.

Figure 7A:
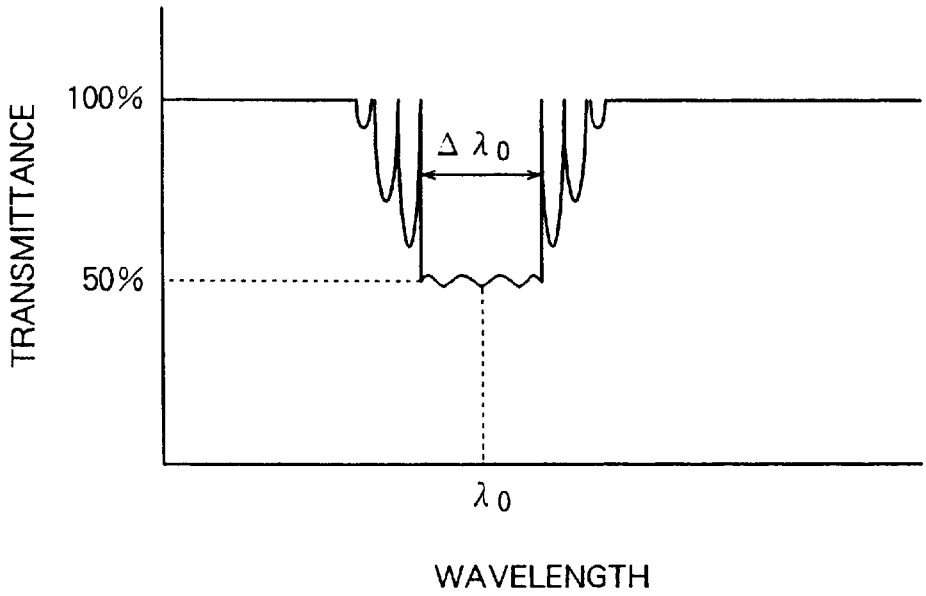
FIG. 7A, and FIG. 7B are diagrams for explaining a principle of polarization conversion when a cholesteric liquid crystal polymer layer is employed for a polarization converting element 103.
Figure 7B:
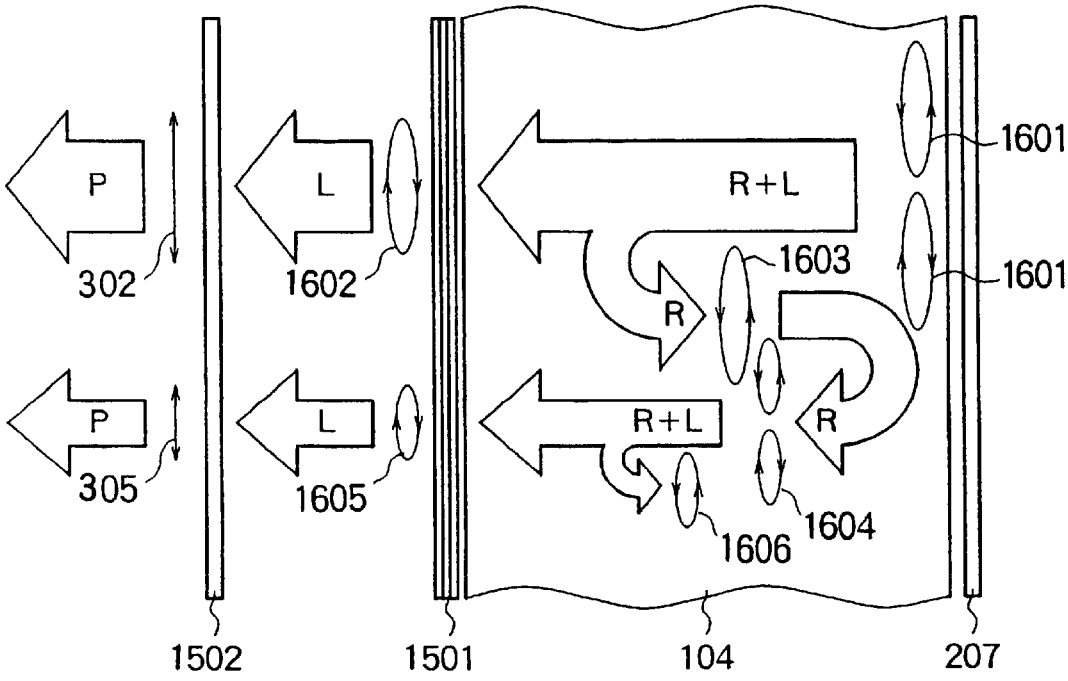

FIG. 7A, and FIG. 7B are diagrams for explaining a principle of conversion of polarization when a layer of a cholesteric liquid crystal polymer is employed for a polarization converting element 103. A cholesteric liquid crystal, as shown in FIG. 7A, with an wavelength $\lambda_0$, which is determined from an average refractive index and a spiral pitch, as a center, and over an interference area of $\Delta\lambda_0$ determined from a spiral pitch of a molecule, possesses birefringence $\Delta n$ and selectivity of the circularly polarized light. It completely transmits the area other than the interference area. By stacking a plurality of layers of a cholesteric liquid crystal layer of respectively different in their spiral pitches or refractive indices, a polarization converting element effective over whole visible light region can be formed. In this case too, as illustrated in FIG. 2, due to multiple reflection between the phosphor 101 and the polarization converting element 1501, it is subjected to polarization converting operation. The polarized light 1602, 1605 which transmit the polarization converting element, being circularly polarized light, by disposing a quarter-wave film 1502, can be converted into the linearly polarized light 302, 305 so as to coincide with a direction of a transmissive axis of the polarized light of the polarizer 403 at the light incident side of an LCCS (FIG. 7B). With the aforementioned constitution, an effect identical as embodiment 1 can be obtained. In addition, due to restriction of the wave-length zone which the interference area of the layer of the cholesteric liquid crystal has, effect of improving color purity can be also attained.

(Embodiment 3)

Figure 8:
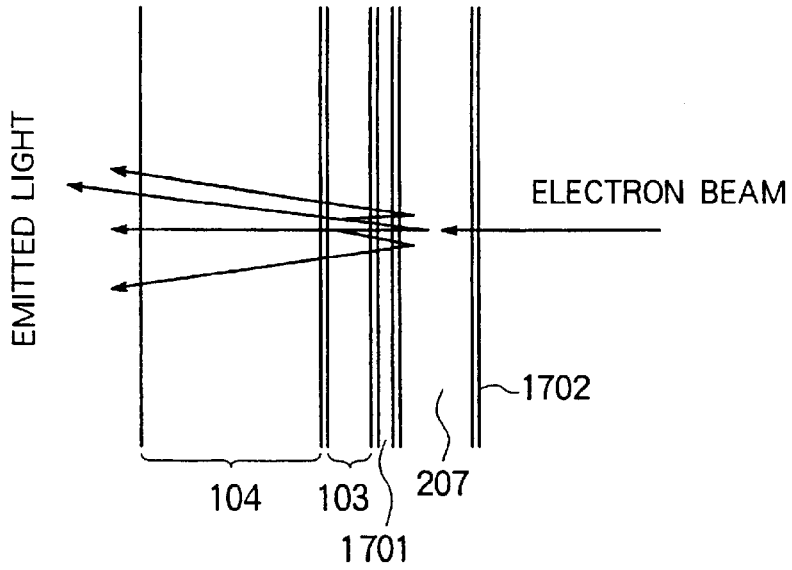
FIG. 8 is a diagram diagrammatically showing another example of a constitution of a display device of the present invention.

FIG. 8 is a diagram showing diagrammatically another example of a constitution of a display device of the present invention. In this example, a polarization converting element 103 is disposed inside a screen glass of a CRT. Other points than this are identical as examples of embodiment 1. As shown in embodiment 1, 2, when a screen glass 104 is intervened between a polarization converting element 103 and a phosphor 101, contrast of the luminous images is deteriorated. This is because display images are blurred due to the effect of scattering generated during multiple reflection due to difference of light paths caused by the screen glass 104. If the display images were blurred, when images of high spatial frequency are intended to be displayed, there occurs a problem that sufficient contrast can not be obtained.

In the example of FIG. 8, through disposition of a polarization converting element 103 inside the screen glass, the difference of light paths can be kept minimum. Thereby, the luminous images of high resolution, excellent contrast can be obtained by the polarized light. As a polarization converting element 103, it is preferable to adopt inorganic material such as a beam splitter of the polarized light of micro-prism type. The reason for this is to maintain the decompressed pressure inside the CRT. However, when a layer of a gas barrier 1701 such as TPX, PP, EVOII and the like is disposed between the phosphor 101 and the polarization converting element 103, a polarization converting element which makes use of organic material can be used.

(Embodiment 4)

Figure 9:
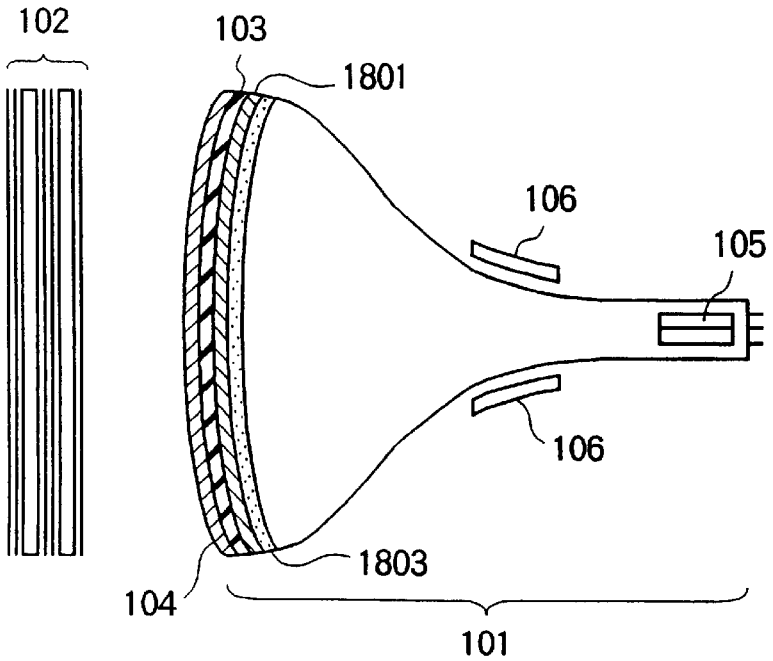
FIG. 9 is a diagram diagrammatically showing another example of a constitution of a display device of the present invention.

FIG. 9 is a diagram showing diagrammatically another example of a constitution of a display device of the present invention. In this example, a polarization converting element 103 is buried between a screen glass 104 and a rear side glass plate 1801 through a transparent intermediate film 1802. Other respect than this is identical as the aforementioned examples. This structure can be obtained by, while employing, for instance, MERUSEN G (products of TOSO) (thickness being about 150 $\mu$m) which is an intermediate film for a laminate glass made of ethylene-vinyl acetate copolymer (EVA) as a transparent intermediate film 1802, Sumitomo 3M DBEF (thickness being about 130 $\mu$m) and a face glass as a polarization converting element, carrying out decompression, heat treatment (for instance, heating at 30 Torr, 100° C., for 10 min.) on the rear side glass plate (thickness being 0.3 to 0.7 mm) to adhere them. Reference numeral 1803 is phosphor. By materializing such a structure, while securing strength by a front thick glass, distance between the polarization converting element and the phosphor layer can be made 1 mm or less, thereby deterioration of the display images can be largely suppressed. Further, since the phosphor layer side is the screen glass, deterioration of the degree of vacuum due to mingling of gas can be prevented.

(Embodiment 5)

Figure 10:
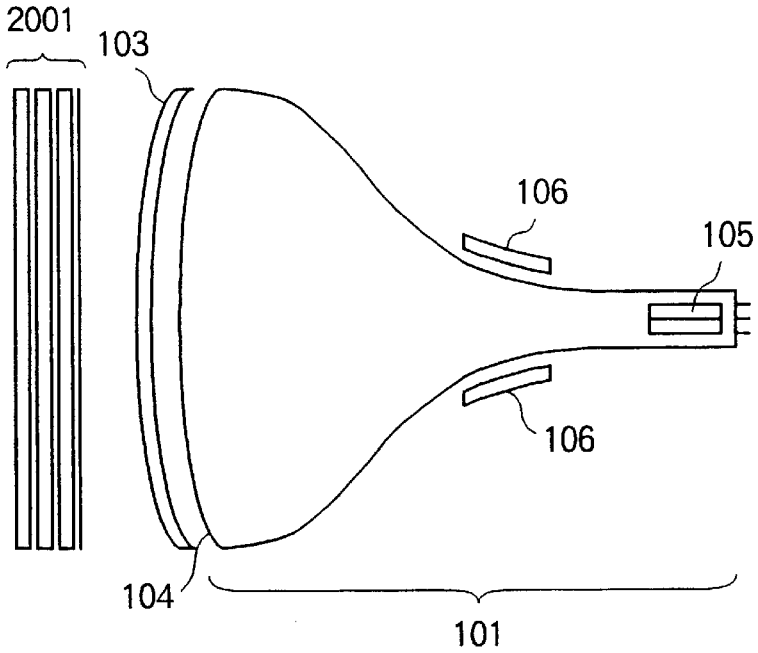
FIG. 10 is a diagram diagrammatically showing another example of a constitution of a display device of the present invention.

FIG. 10 is a diagram showing diagrammatically another example of a constitution of a display device of the present invention. In this example, an LCCS 2001 in which a guest-host type liquid crystal is adopted is employed.

Figure 11:
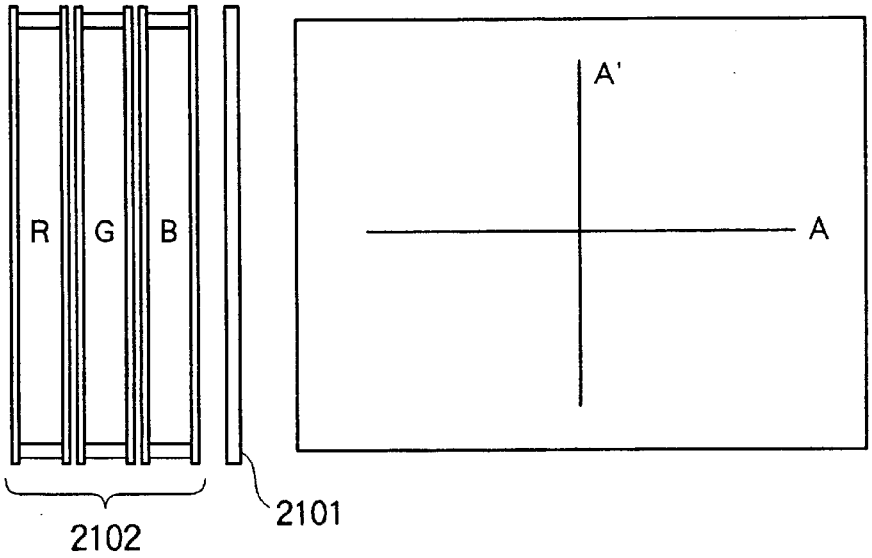
FIG. 11 is a diagram showing an example of a constitution of the LCCS illustrated in FIG. 10 and relation of optical disposition of the LCCS and a polarization converting element.

FIG. 11 is a diagram showing relation between details of the LCCS illustrated in FIG. 10 and an optical disposition of a polarization converting element 103. The guest-host liquid crystal cell 2102 has a 3 layer structure, into respective layers, dichroic dyes displaying R, G, B colors which are 3 primary colors are dissolved. Incidentally, not 3 primary colors of additive color mixture, but 3 primary colors of subtractive color mixture (CMY system) may be employed. This LCCS can be controlled of its coloration/transparency state of the transmitted light by inputting voltage to each liquid crystal layer independently. The respective liquid crystal layers take a homogeneous structure having its absorptive axis in a direction of A axis when being colored. When being transparent, it takes homeotropic molecular alignment. On the light incident side of the guest-host liquid crystal, a polarizer 2101 having a transmissive axis of the polarized light at A, an absorptive axis at A' is disposed. Though not shown in the figure, the transmissive axis of the polarized light of the polarization converting element 103 is aligned with A.

When display of, for instance, R light is carried out with the LCCS 2001, it is only needed to obtain a colored state through homogeneous alignment of the liquid crystal layer containing a dichroic dye displaying R color. And, 2 other liquid crystal layers are only needed to be made homeotropic molecular alignment to be a transparent state. This time, the light transmitted the polarization converting element 103 and polarized in the direction of A axis is not absorbed by the polarizer 2101. Whereas, GB wavelength components of this light are absorbed by dichroic dyes of the R liquid crystal layer. Thereby, display of the desired R light can be realized. Display of the G light, B light can be carried out identically. Therefore, by varying voltage inputted to each liquid crystal layer, color display can be carried out.

The light outputted without being converted by the polarization converting element 103 is polarized in a direction of A' axis orthogonal to a light absorptive axis of the guest-host liquid crystal cell. Therefore, this light is not absorbed by a liquid crystal cell. Anyway, this light is completely absorbed by a polarizer 2101 disposed on the incident side of a liquid crystal cell 2102. Therefore, without deteriorating color purity of a color filter 2001, efficient color display can be carried out.

In this example, instead of dichroic dyes of 3 primary colors of R (red), G (green), B (blue), dichroic dyes of C (cyan), M (magenta), Y (yellow) can be used. For instance, when R is to be displayed, liquid crystal layers of M and Y are homogeneously oriented to color, C layer is only needed to be homeotropic molecular aligned to be transparent.

Further, without disposing a polarizer 2101, the liquid crystal orientation during coloration may be made to have, not a homogeneous alignment, but a twisted spiral structure. In this case, in order to color most efficiently the light having the component of the polarized light in the direction of A axis therein its light intensity is large, it is most preferable to make a rubbing direction of a substrate of the light incident face side coincided with the A direction. Further, when CMY dyes are employed, it is desirable to make the dominant direction of the polarized light of light outputted from the liquid crystal cell coincide with the rubbing direction of the light incident side of the liquid crystal cell of the next step by setting an angle of twisting of a liquid crystal at multiples of 180° or by disposing a retardation film therebetween. With the aforementioned constitution, in addition to attaining an effect identical as embodiment 1, an effect of capable of reducing number of the polarizer can be obtained.

(Embodiment 6)

Figure 12:
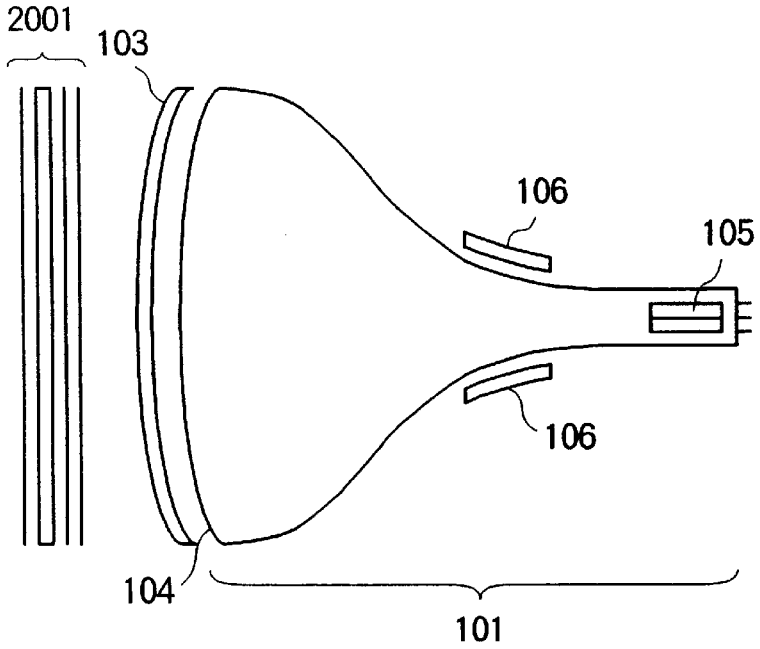
FIG. 12 is a diagram diagrammatically showing another example of a constitution of a display device of the present invention.
Figure 13A:
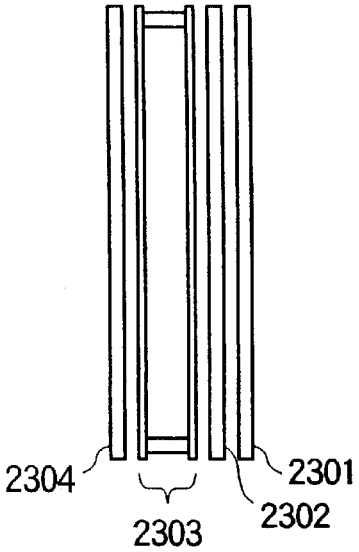
FIG. 13A, and FIG. 13B are diagrams showing an example of the constitution of the LCCS of FIG. 12 and relation of optical disposition of the LCCS and a polarization converting element.
Figure 13B:
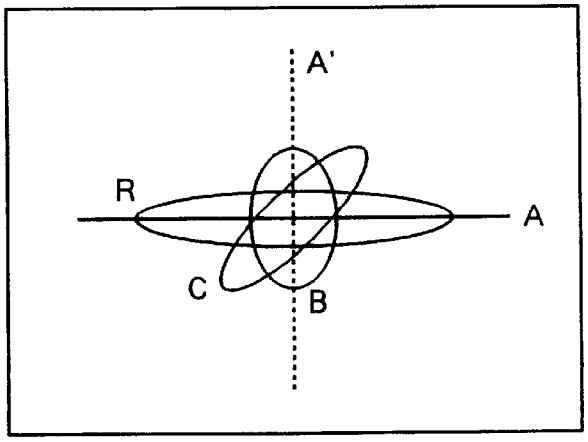

FIG. 12 is a diagram showing diagrammatically another example of a constitution of a display device of the present invention. In this example, an LCCS 2201 employing ECB (electrically controlled birefringence) mode is used. FIG. 13A and FIG. 13B respectively showing examples of a constitution of the LCCS and an optical layout of a polarization converting element 103.

An ordinary ECB liquid crystal cell has constitution that sandwiches a retardation film 2302, a liquid crystal cell 2303 between polarizers 2301, 2304 being in parallel Nicols. When transmitting axes of the polarized light of the polarizers 2301, 2304 are set to be A, the light of each wavelength component of RGB becomes respectively different elliptically polarized light due to the retardation film 2302 and the liquid crystal cell 2303. Through input of a predetermined voltage on the liquid crystal cell 2303, alignment of the liquid crystal can be controlled. A state of the elliptically polarized light of the light of respective color component can be accordingly controlled. FIG. 13B shows a state of the elliptically polarized light of the respective colors during display of R light. Though not shown in the figure, in order to increase a ratio of the light transmitting the LCCS 2201, it is preferable for a transmissive axis of the polarized light of the polarization converting element 103 to be coincided with a transmissive axis of the polarized light of the polarizer 2301, that is, a direction of A axis.

Further, in order to enhance color purity, it is effective that either emission characteristics of the CRT phosphors are made to be 3 wavelength type of which peak wavelengths are in RGB respectively, or narrow band pass filters of RGB consisting of such as dielectric multiply-layered films transmitting only a desired wavelength is disposed.

(Embodiment 7)

Figure 14:
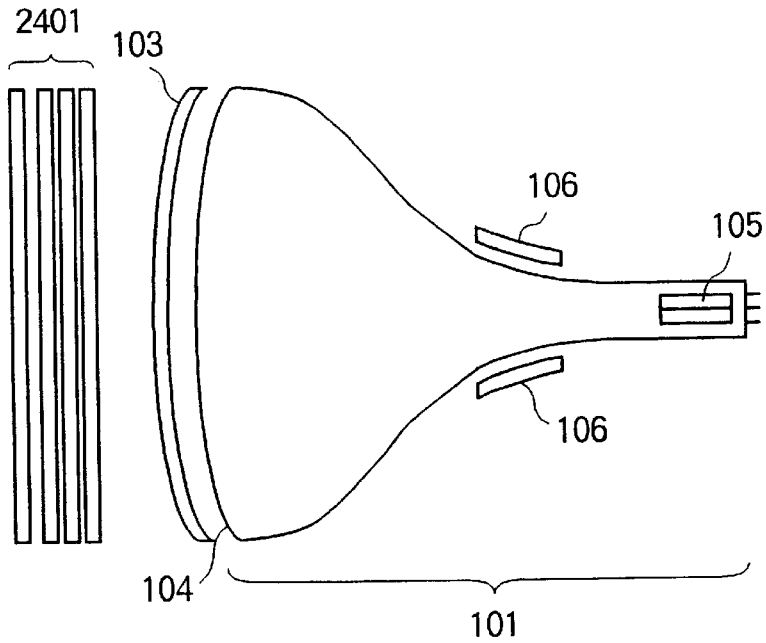
FIG. 14 is a diagram diagrammatically showing another example of a constitution of a display device of the present invention.
Figure 15:
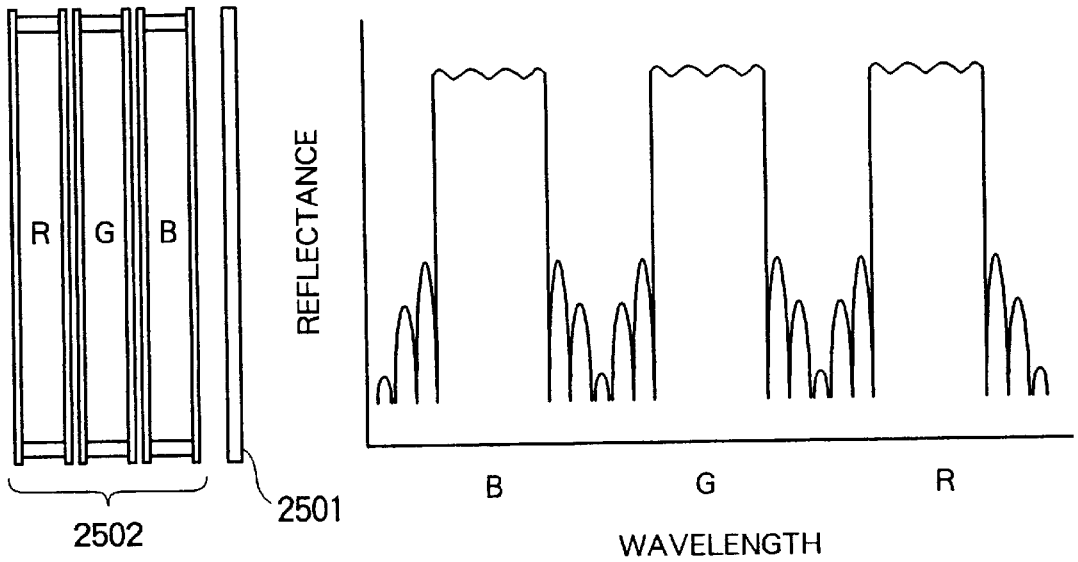
FIG. 15 is a diagram diagrammatically showing another example of a constitution of a display device of the present invention.

FIG. 14 is a diagram showing diagrammatically another example of a constitution of a display device of the present invention. In this example, an LCCS 2401 using a selective reflection mode of a cholesteric liquid crystal is employed. FIG. 15 is a diagram showing an example of a constitution of this LCCS.

A cholesteric liquid crystal, when it is in a planar phase in which a spiral axis of a liquid crystal molecule is in a direction vertical to substrates which sandwich a liquid crystal layer, shows selective reflectivity for the elliptically polarized light of a particular wavelength band. When it is in a homeotropic phase, the spiral structure of a liquid crystal molecule is lost, to be a transmitting state. This LCCS, together with stacking 3 layers of a cholesteric liquid crystal cell 2502 which has reflectivity in the RGB wavelength regions, by controlling input voltage to each layer of the liquid crystal independently, selects between a planar phase and a homeotropic phase.

On the light incident side of the liquid crystal cell 2502, a quarter-wave film 2501 is disposed for converting the linearly polarized light outputted from a polarized light separation element 102 into the circularly polarized light. The direction of the circularly polarized light is one in which the circularly polarized light is totally reflected.

When, for instance, R light is displayed with this structure, an R reflective liquid crystal cell is made a homeotropic phase, B, G light reflective liquid crystal cells are made a planar phase. Since, among the light components entered into the liquid crystal cell 2502, B, G component are reflected, the remaining R component only transmits to make possible to display R light. Display of G light, B light can be carried out in an identical manner.

In order to enhance color purity of light to be displayed in this display device, dye can be dissolved in liquid crystal, or 3 wavelength emitting type phosphors are preferably employed. Further, on the light incident face side of a quarter-wave retardation film 2501, a polarizer having a transmissive axis of the polarized light in an identical direction with a transmissive axis of the polarized light of a polarization converting element 103 can be added. Thereby, unnecessary component of the polarized light can be eliminated. Further, as described in embodiment 2, when a cholesteric liquid crystal is employed for a polarization converting element 103, by omitting both quarter-wave films 2501, such a layout as that the circularly polarized light component transmitting the polarization converting element becomes reflected light of the liquid crystal cell in a planar phase may be adopted.

Thus, according to the present invention, a display device of optically high efficiency, high brightness, and high definition compared with the conventional display device can be provided.

(Embodiment 8)

Figure 16:
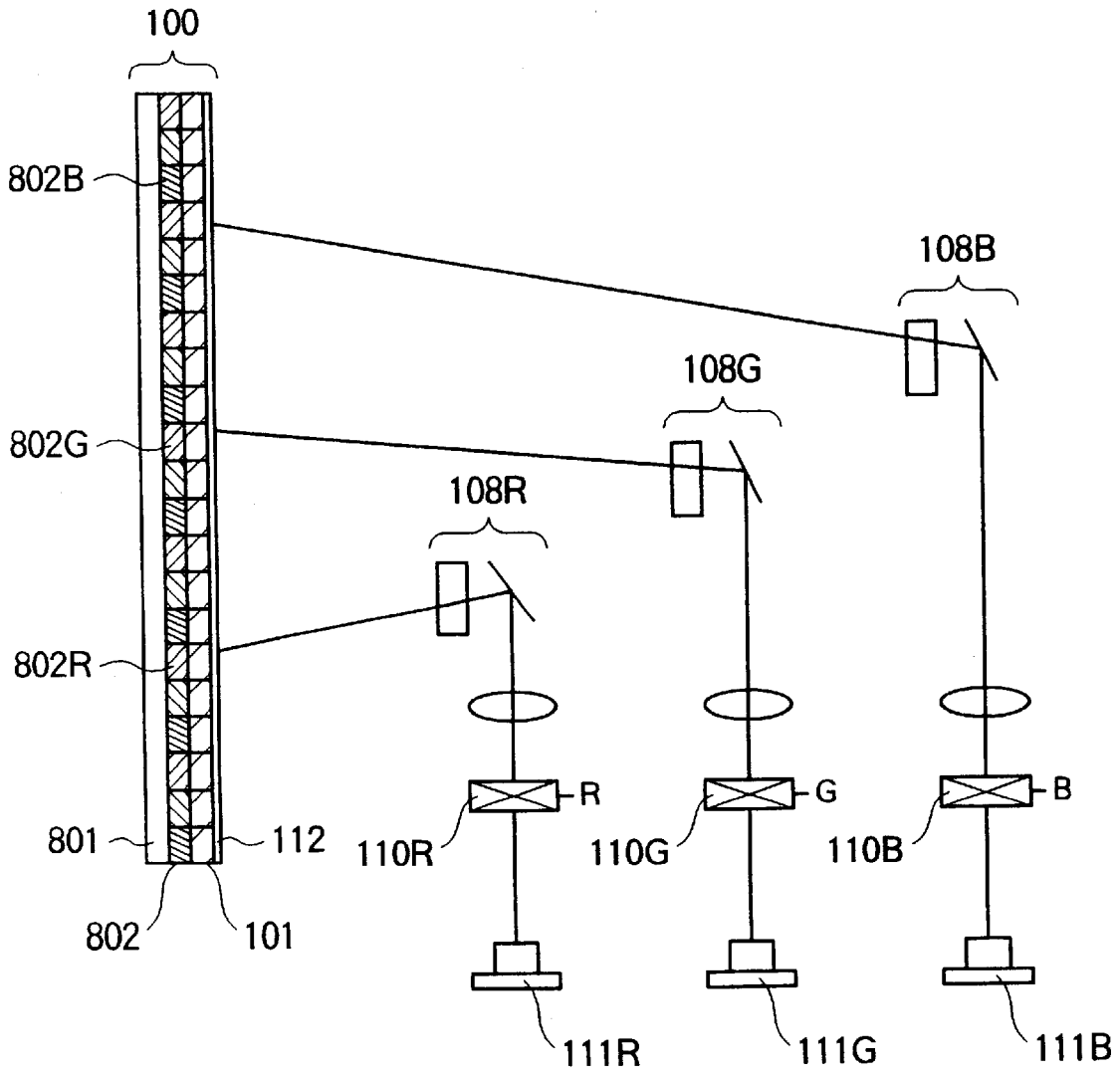
FIG. 16 is a diagram diagrammatically showing an example of a constitution of a display device of the present invention.

FIG. 16 is a diagram showing an example of a constitution of a display device of the present invention.

This display device carries out display of color images by, after modulation in their intensities according to data signals to be displayed, scanning source lights irradiated from light sources 111R, 111G, 111B two dimensionally to a screen 100 on which the phosphor layer 101 is disposed.

Here, as light sources 111R, 111G, 111B, an InGaN semiconductor laser of oscillation wavelength of about 380 nm is employed. Further, on a screen 100 which is an area images to be displayed, a phosphor layer 101 which emits in the visible region when the light from the light source is irradiated is disposed. Here, to emit white light combined as a light source, a plurality of phosphors are mixed and disposed. Further, the thickness of the phosphor layer 101 is set in the range of about 5 $\mu$m to 10 $\mu$m.

The source lights outputted from the light sources 111R, 111G, 111B are sequentially modulated in their intensities by a modulating means according to displaying data signals of respective RGB. Here, as a modulating means, intensity modulating elements 110R, 110G, 110B, which combines a diffraction grating type liquid crystal cell controlling transmission/diffraction of the source light, and a slit, are used.

The lights modulated in their intensities by an intensity modulating means are scanned by scanners two dimensionally on a screen 110 coinciding with display signal. Here, as scanners, XY scan mirrors 108R, 108G, 108B (product of General Scanning Co,. G series) are being used.

Further, between the intensity modulating elements 110R, 110G, 110B and the XY scan mirrors 108R, 108G, 108B, optical systems 109R, 109G, 109B are disposed. The optical systems 109R, 109G, 109B converge the source lights onto local areas corresponding to respective unit pixels on a screen 110.

Figure 17A:
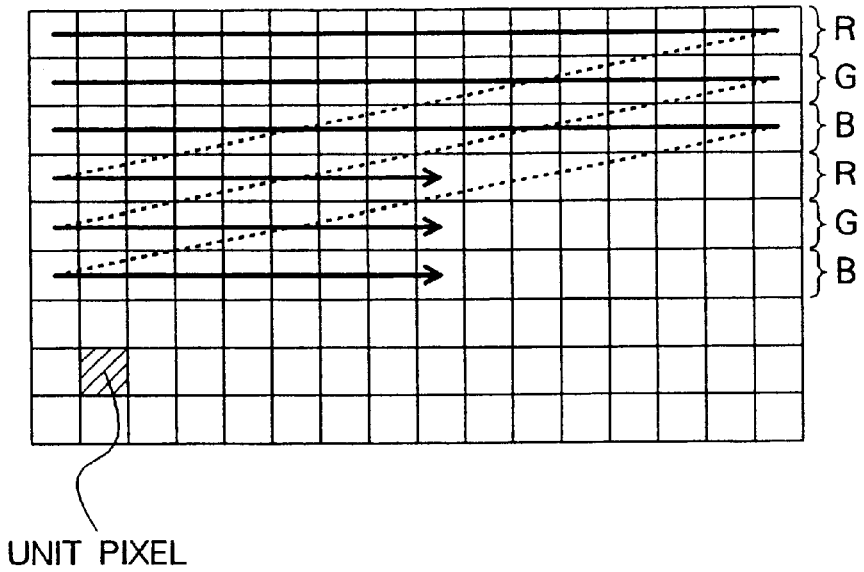
FIG. 17A, and FIG. 17B are diagrams for explaining situations scanning a screen on which a phosphor layer is disposed with a source light modulated in its intensity.
Figure 17B:
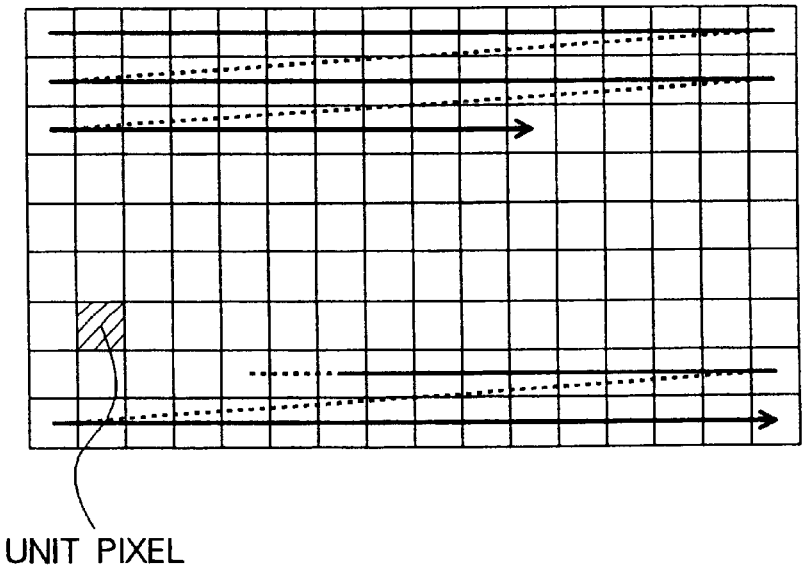

FIG. 17A, and FIG. 17B are diagrams for describing states scanning the screen 100 thereon phosphor layer 101 is disposed with a source light modulated in its intensity.

Here, a light source of 3 channels are being used. Therefore, X-Y scan mirrors 108R, 108G, 108B are only needed to be driven at 3 phase, 60 Hz (FIG. 17A). When color images are displayed with a light source of one channel, 180 Hz is needed to drive (FIG. 17B).

With such a constitution, the source lights modulated in their intensities in response to data signals to be displayed enters on each unit pixel area of the phosphor layer 101 disposed on the screen 100. The phosphor layer 101 emits in the visible region upon irradiation. Therefore, on the screen, predetermined two dimensional images in which gradations are distributed for respective pixels are drawn.

Incidentally, when there is non-linearity between the intensity of the light incident to the phosphor layer 101 and the intensity of the light emitted from the phosphor layer, the intensity of the source light is only required to be compensated for this non-linearity.

In the display device of the present invention illustrated in FIG. 16, on a face opposite side to the light incident face of the phosphor layer 101, an RGB color filter 802 is disposed. The RGB color filter 802 is disposed so that the lights which are emitted from the phosphor layer 101 and are modulated in response to display signals of respective colors of RGB are colored red, green, blue, respectively. That is, the light emitted from the phosphor layer 101 due to irradiation of the source light outputted from the light source 111R, and modulated in response to display signal of red color by an intensity modulating element 110R enters the red color area of the RGB color filter 802. The light emitted from the phosphor layer 101 due to irradiation of the source light outputted from light source 111G, and modulated in response to display signal of green color by an intensity modulating element 110G enters the green color area of the RGB color filter 802. The light emitted from the phosphor layer 101 due to irradiation of the source light outputted from the light source 111B, and modulated in response to display signal of blue color by an intensity modulating element 110B enters the blue color area of the RGB color filter 802.

Here, for an RGB color filter 802, a color filter made of organic dyes of excellent coloring property are employed. Further, this color filter 802 is formed in stripe on a face glass 801 with screen printing method.

Further, on the light incident face side of the phosphor layer 101, a dichroic mirror 112 is disposed. The dichroic mirror 112 transmits the source light and, at the same time, reflects the visible component of the light emitted from the phosphor layer 101. Thereby, the light emitted from the phosphor layer 101 is outputted to the observing face side (face glass 801 side) with high efficiency, to improve display brightness.

Incidentally, though not shown in the figure, a polarizer may be stuck on a face on the opposite side with respect to the phosphor layer 101 of the face glass 801, a polarization converting sheet may be disposed between the face glass 801 and the color filter 802, or between the color filter 802 and the phosphor layer 101. Thereby, with hardly reducing display brightness, reflection of the ambient light can be reduced to about ½.

Thus, according to the present invention, with a simple constitution, a display device, which is easy to make large a screen, bright and excellent in its display quality, can be provided. Further, in a display device of the present invention, compared with a CRT, an optical system of a beam drawing the display area is not required to be disposed in a bulky, reduced pressure container. Therefore, weight of the display device can be made light. Further, it is not required to employ charged particles as a drawing beam, influence of ambient disturbance such as noise can be made to hardly affect.

(Embodiment 9)

Figure 18:
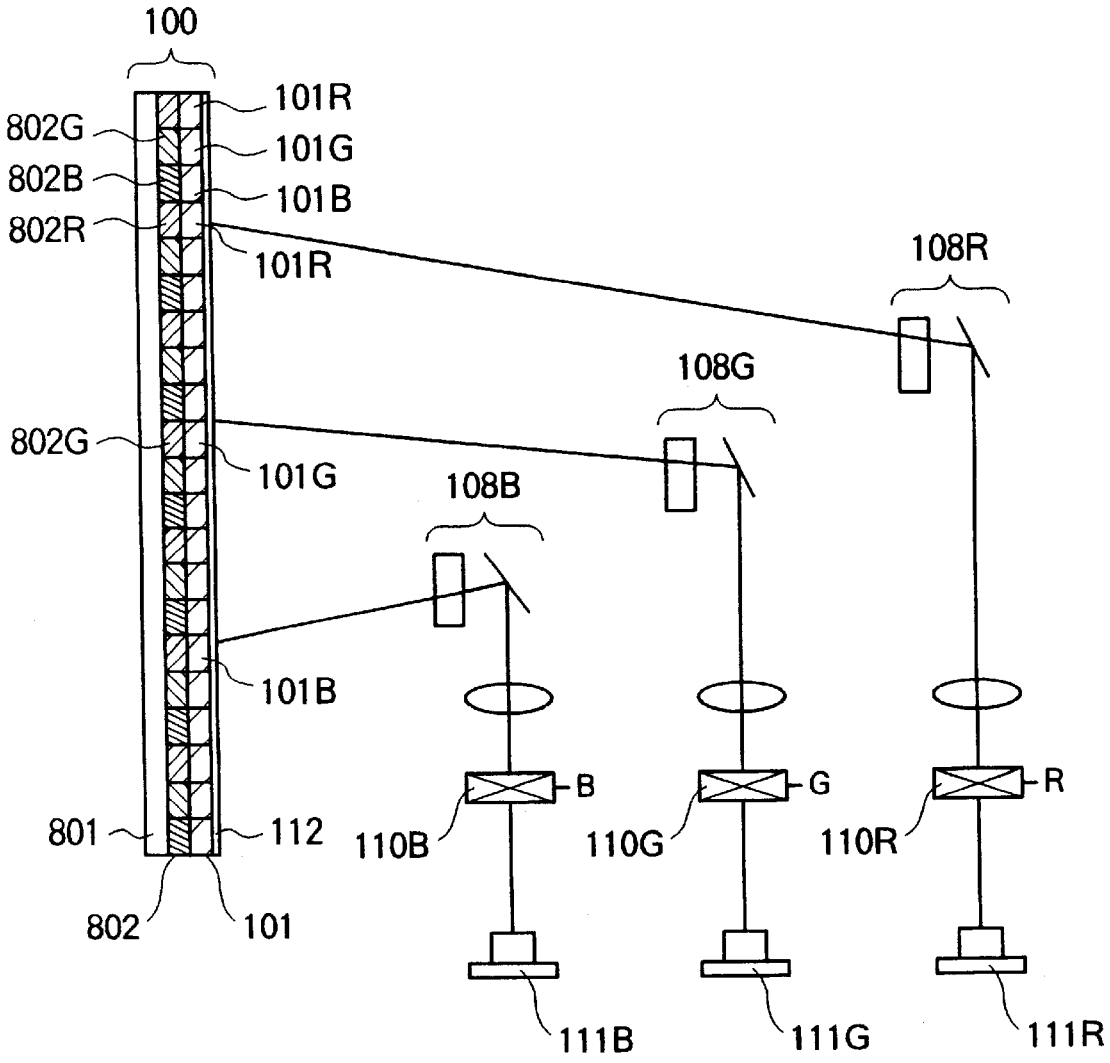
FIG. 18 is a diagram diagrammatically showing another example of a constitution of a display device of the present invention.

FIG. 18 is a diagram showing another example of a constitution of a display device of the present invention.

In the display device of the present invention illustrated in FIG. 16, on a screen 100 which is a display area, a phosphor layer 101 emitting white light is disposed without being separated. In a display device illustrated in FIG. 18, on the screen 100, respective phosphors 101R, 101G, 101B which emit in R, G, B, respectively are disposed. The phosphors 101R, 101G, 101B are disposed corresponding to the RGB arrangement of the color filter.

The light from the light sources 111R, 111G, 111B scan respectively only on the phosphor 101 which corresponds the colors of the images to be drawn. That is, on the respective phosphors 101 arranged in matrix, the light from the light source modulated in response to the display signal enters selectively. And, the light emitted from the phosphor 101R transmits the R region 802R of the color filter 802, the light emitted from the phosphor 101G transmits the G region 802G of the color filter 802, the light emitted from the phosphor 101B transmits the B region 802B of the color filter 802.

As mentioned above, emission efficiency of a phosphor depends on wavelength of the incident light. Therefore, in order to make wavelength region excellent in emission efficiency of the phosphor to be employed coincided with the wavelength of the light source, it is preferable to use combining the wavelengths of the incident light and kinds of phosphors.

Through adoption of such a structure, the emission of the phosphor can be utilized most efficiently, resulting in improvement of display quality.

(Embodiment 10)

Figure 19:
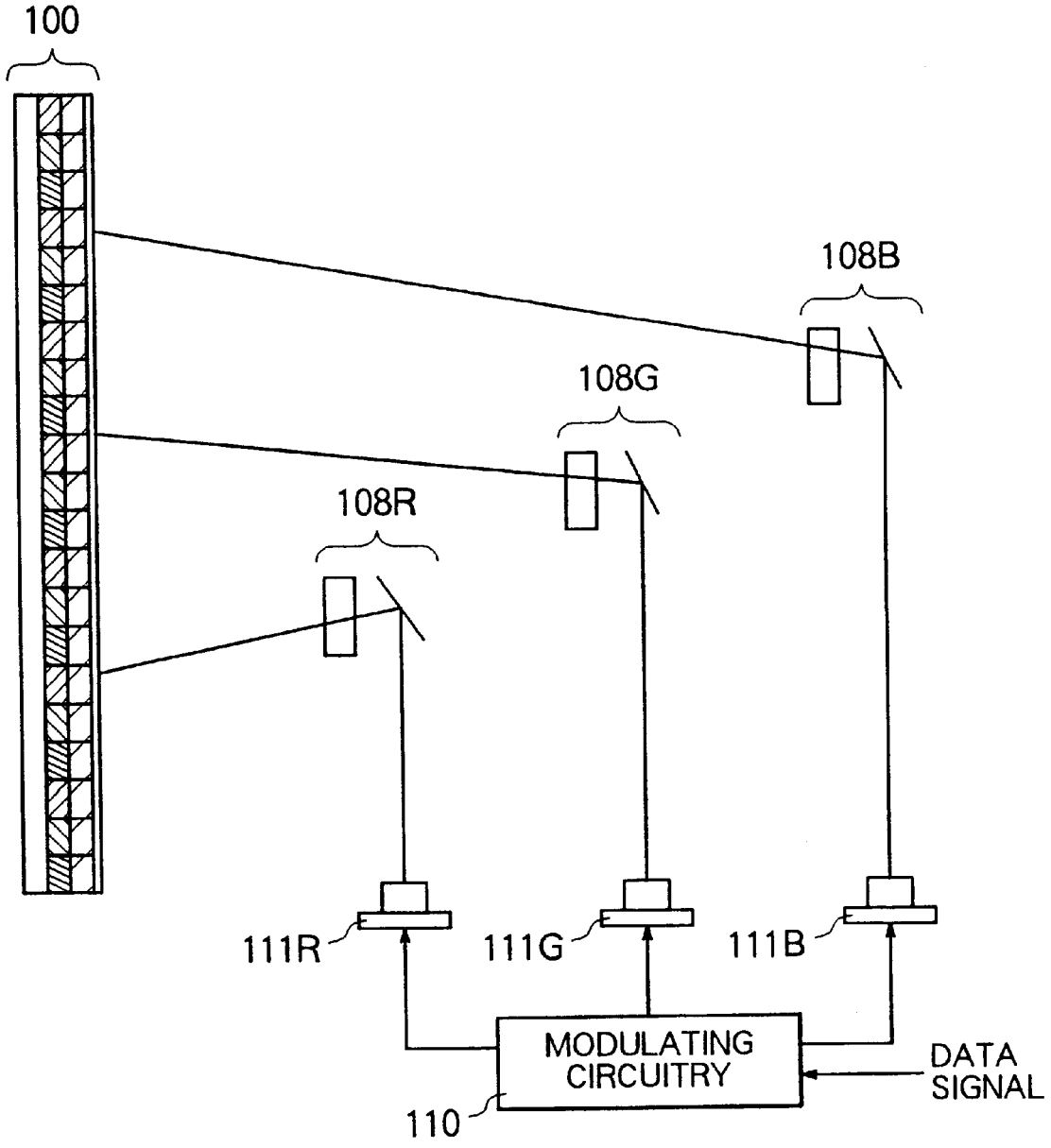
FIG. 19 is a diagram diagrammatically showing still another example of a constitution of a display device of the present invention.

FIG. 19 is a diagram showing diagrammatically still another example of a constitution of a display device of the present invention.

In the display device of the present invention illustrated in FIG. 16, and FIG. 18, the lights outputted from the light sources 111R, 111G, 111B are modulated in their intensities in response to the signals to be displayed. In the display device of the present invention illustrated in FIG. 18, the source lights themselves are modulated in their intensities in response to the signals to be displayed.

That is, from light sources 111R, 111G, 111B, the lights which are modulated in their intensities in response to the signals to be displayed are sequentially irradiated to scanning means 108R, 108G, 108B. With a modulating means such as, for instance, a modulating circuitry 110, according to the signals to be displayed, input voltages to the light sources 111R, 111G, 111B may be pulse modulated. Thereby, a beam of the light different in its intensity corresponding to display signal can be irradiated.

With adoption of such a constitution, only scanning means is needed to be disposed between from the light source to the screen. Therefore, the constitution of the display device can be made more simple. Further, the loss caused by absorption, scattering of the source light due to the optical system is reduced, to improve utility efficiency of light. Therefore, display quality can be enhanced. Further, the degree of freedom on selection of wavelength of light source can be made large.

(Embodiment 11)

Figure 20:
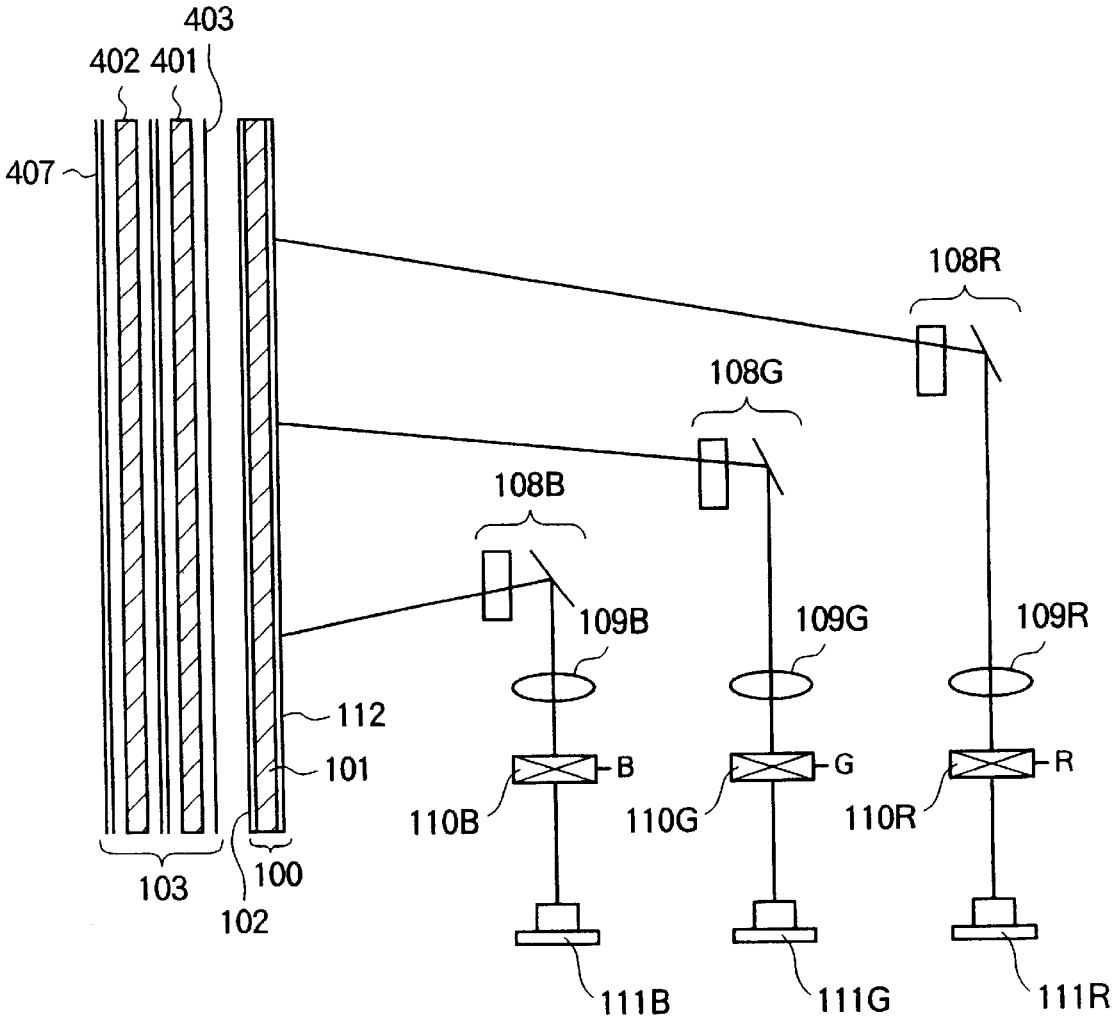
FIG. 20 is a diagram diagrammatically showing an example of a constitution of a display device of the present invention.

FIG. 20 is a diagram showing diagrammatically another example of a constitution of a display device of the present invention.

In this display device, in order to display RGB images, 3 channels of light sources 111R, 111G, 111B are provided. The drawing optical systems for irradiating this source lights to the screen are also provided with 3 systems respectively corresponding to the light sources 111R, 111G, 111B. That is, the drawing optical system is constituted of modulating elements 110R, 110G, 110B, optical systems 109R, 109G, 109B, XY scan mirrors 108R, 108G, 108B.

For light sources 111R, 111G, 111B, an InGaN semiconductor laser emitting near ultraviolet light of an oscillating wavelength of about 380 nm is employed. Therefore, this source light is capable of transmitting glass and plastic. The light outputted from this light source is gradation controlled by modulating elements 110R, 110G, 110B in response to the signals to be displayed corresponding to the images. The modulating elements 110R, 110G, 110B are constituted of a diffraction grating type liquid crystal cell controlling, for instance, transmission/diffraction and a slit. As described above, also so as to compensate for the non-linearity of the emission characteristics of the phosphor 101, when inputting to the modulating circuitry 110, the signal is compensated for in advance.

The source lights of 3 systems for R image, G image, B image modulated in their intensities are focussed by the optical systems 109R, 109G, 109B, respectively, so as to converge on the phosphor layer 101. Further, through irradiation on the pixel area of the screen 100 by XY scanning mirrors 108R, 108G, 108B (General Scanning Co,. G series), two dimensional images are displayed by light emitted from the phosphor layer 101.

A dichroic mirror 112 on the source light incident side of the phosphor layer 101, and a polarization converting sheet 103 (product of Sumitomo 3M Co,. DBEF) on the light outputting side are disposed integrated. Further, on the outsides (on the observer side), an LCCS 102 constituting of two sheets of anti-ferroelectric liquid crystal cells and a plurality of color polarizers is disposed. The constitution of the LCCS is identical as described above.

Figure 21:
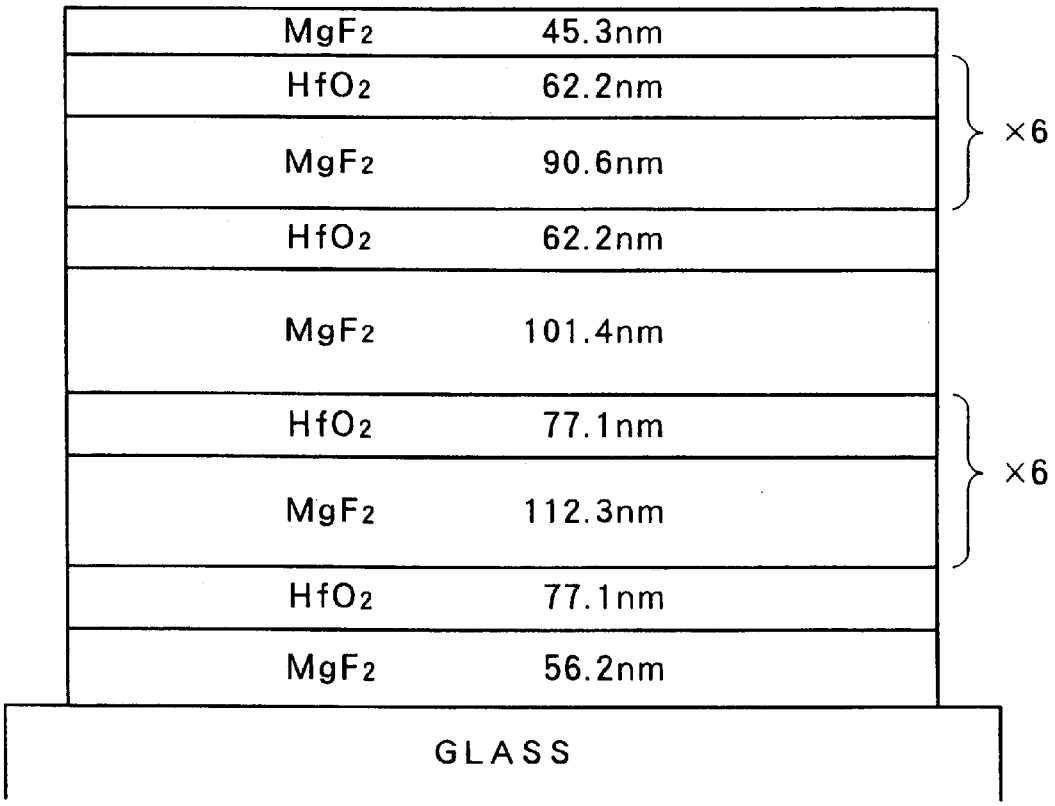
FIG. 21 is a diagram schematically showing a structure of a dichroic mirror.
Figure 22:
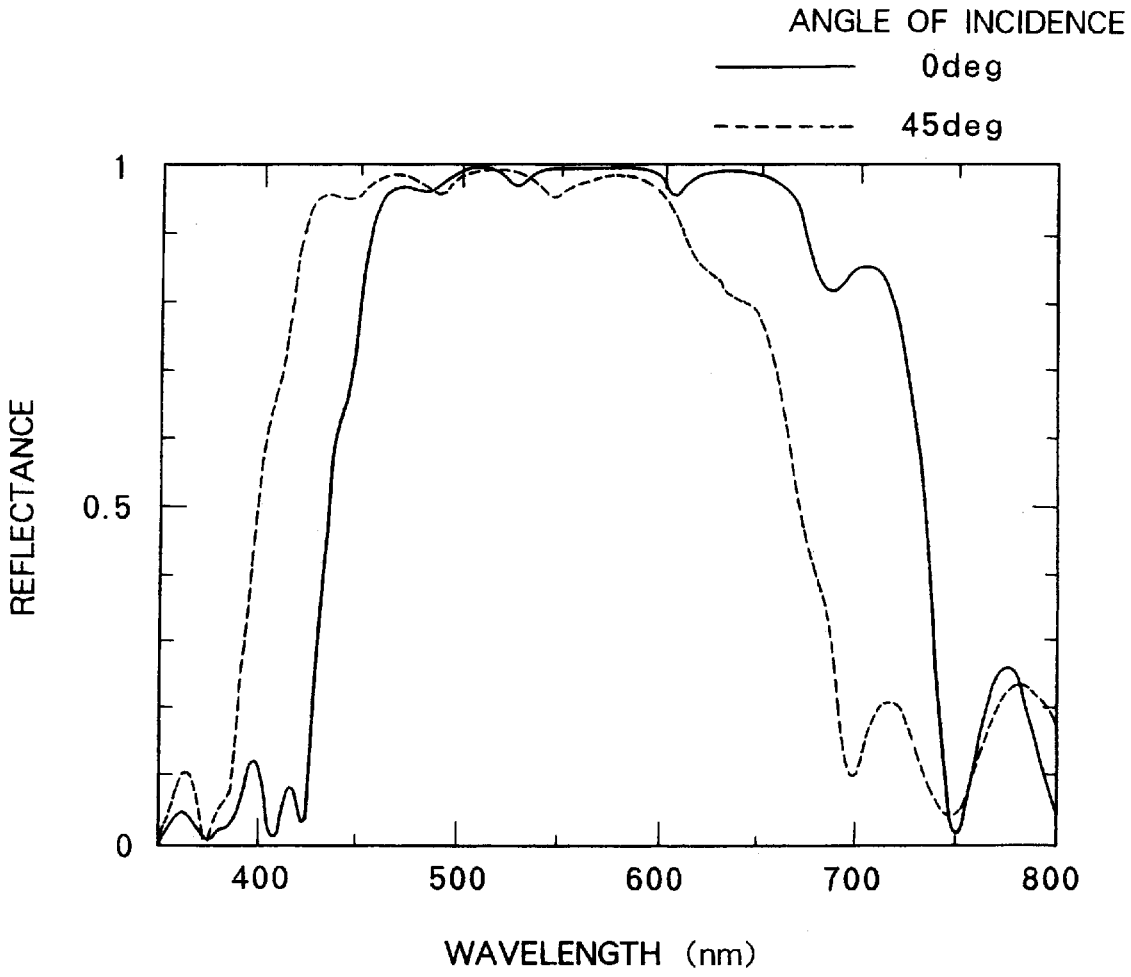
FIG. 22 is a diagram showing reflectance characteristics of a dichroic mirror.

FIG. 21 is a diagram showing schematically a constitution of a dichroic mirror 112, FIG. 22 is a diagram showing reflectance thereof. On a glass substrate, a layer of low refractive index consisting of $MgF_2$ and a layer of high refractive index consisting of $HfO_2$ are stacked as shown in FIG. 21 with, for instance, sputtering method. With adoption of such a constitution, reflectance such as shown in FIG. 22 could be obtained.

Due to the dichroic mirror, when the source light of about 380 nm enters either vertically or even from a direction of slanting angle of 45°, the source light can transmits. Further, the visible component of wavelength of about 400 to 700 nm of the light emitted from the phosphor can be reflected.

Incidentally, operation principle of a polarization converting sheet, operation principle of an LCCS are as described as in FIG. 2, FIG. 3A, FIG. 3B, FIG. 3C, FIG. 4A, FIG. 4B.

Figure 23:
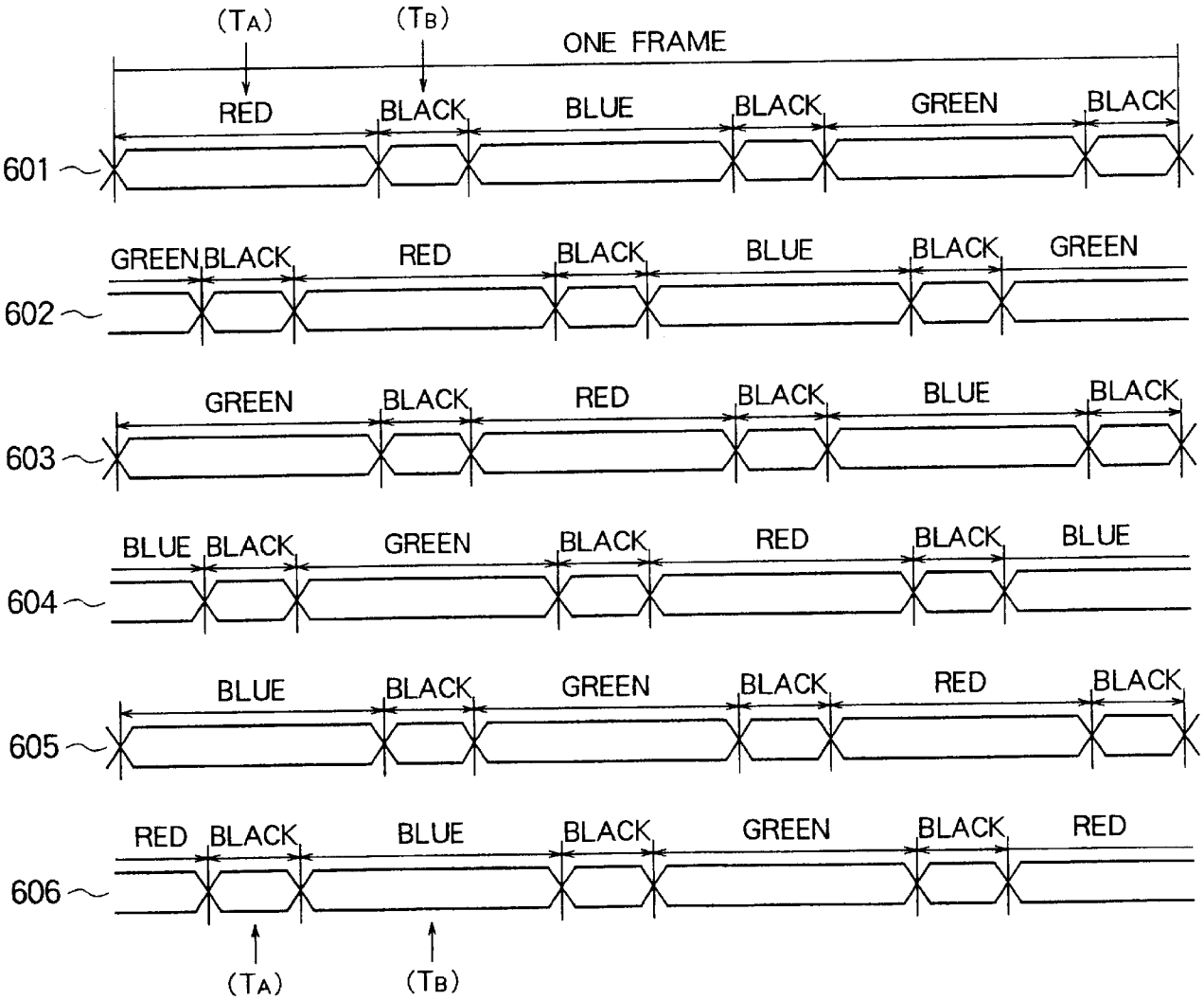
FIG. 23 is a diagram for explaining correspondency between switching timing of display of an LCCS and scanning position of a source light.

FIG. 23 is a diagram for describing correspondency between timing of switching the display of LCCS 102 and scanning of light from light sources 111R, 111G, 111B.

Figure 24A:
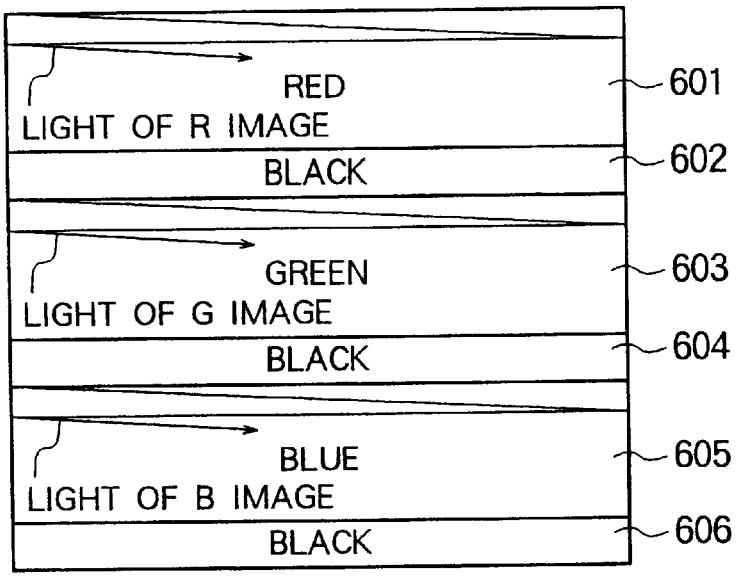
FIG. 24A, and FIG. 24B are diagrams showing states of display of display areas of a display device of the present invention.
Figure 24B:
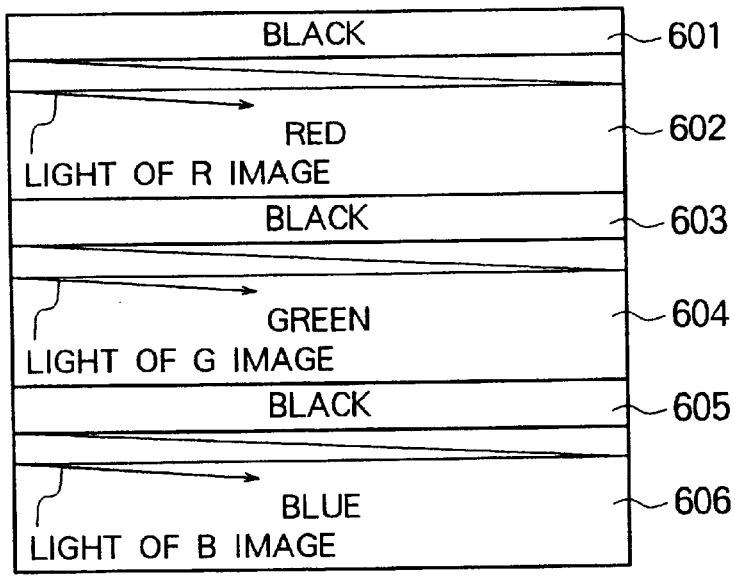

FIG. 24A and 24B are diagrams showing states of display of display areas at a certain time, FIG. 24A shows a state of display at the time ($T_A$) of FIG. 23, FIG. 24B shows a state of display at the time ($T_B$).

The LCCS, though not shown in the figure, by dividing, for instance, a transparent electrode consisting of ITO (Indium Tin Oxide) into six strips, can drive display areas 601, 602, 603, 604, 605, 606, independently. That is, by providing a plurality of light sources 111, an LCCS 102 divided into a plurality of areas, it needs only to draw respective RGB images simultaneously on different areas on a screen of a phosphor layer 101 with respective source lights, and to switch the colors to be displayed of the areas corresponding to unit pixel areas 100*a* of the LCCS 102 corresponding to the areas thereon the RGB images are drawn.

Each display area carries out display of 3 colors of RGB and black display during an interval of 1 frame (1/60s). However, in order to avoid input of bias voltage to a liquid crystal cell in an LCCS, each display interval is made equal.

Further, the black display interval is divided into, for instance, equal three periods, each thereof is inserted when each RGB is switched. Therefore, flickering disturbance caused due to long persistence of the phosphor during switching of display colors can be effectively reduced.

The colors to be displayed of the display areas 601 to 606 are switched by positions which are irradiated by scanning of lights from the light sources 111R, 111G, 111B.

At the time $T_A$, the light from the light source 111R irradiates the area 601, the light from the light source 111G irradiates the area 603, and the light from the light source 111B irradiates the area 605. Therefore, the areas 601, 603, 605, carry out red, green, blue display, respectively, the areas 602, 604, 606 other than these carry out black display.

At the time $T_B$, drawing positions of the RGB images are shifted from areas 601, 603, 605 to areas 602, 604, 606. Therefore, the corresponding respective areas of 602, 604, 606 become R, G, B display. In addition, the areas 601, 603, 605 where color display had been carried out become black display.

By repeating such a scroll operation, during 1 frame interval, RGB images can be displayed on the whole display areas.

Incidentally, in place of an LCCS 102, the aforementioned RGB color filter 802 can be employed.

Lights from the light sources 111R, 111G, 111B scan only on the phosphors 101 corresponding to the colors of the images to be drawn, respectively. That is, on the respective phosphors 101, the lights from the light sources modulated in response to the display data signals enters selectively. In addition, the light emitted from the phosphor 101R transmits the R area of the color filter 802. Further, the light emitted from the phosphor 101G transmits the G area of the color filter 802. Further, the light emitted from the phosphor 101B transmits the B area of the color filter 802.

Through adoption of such a structure, the lights emitted from the phosphors can be most efficiently utilized, resulting in improvement of the image quality.

(Embodiment 12)

An example of driving the display device of the present invention described in embodiment 11 will be described.

Figure 25:
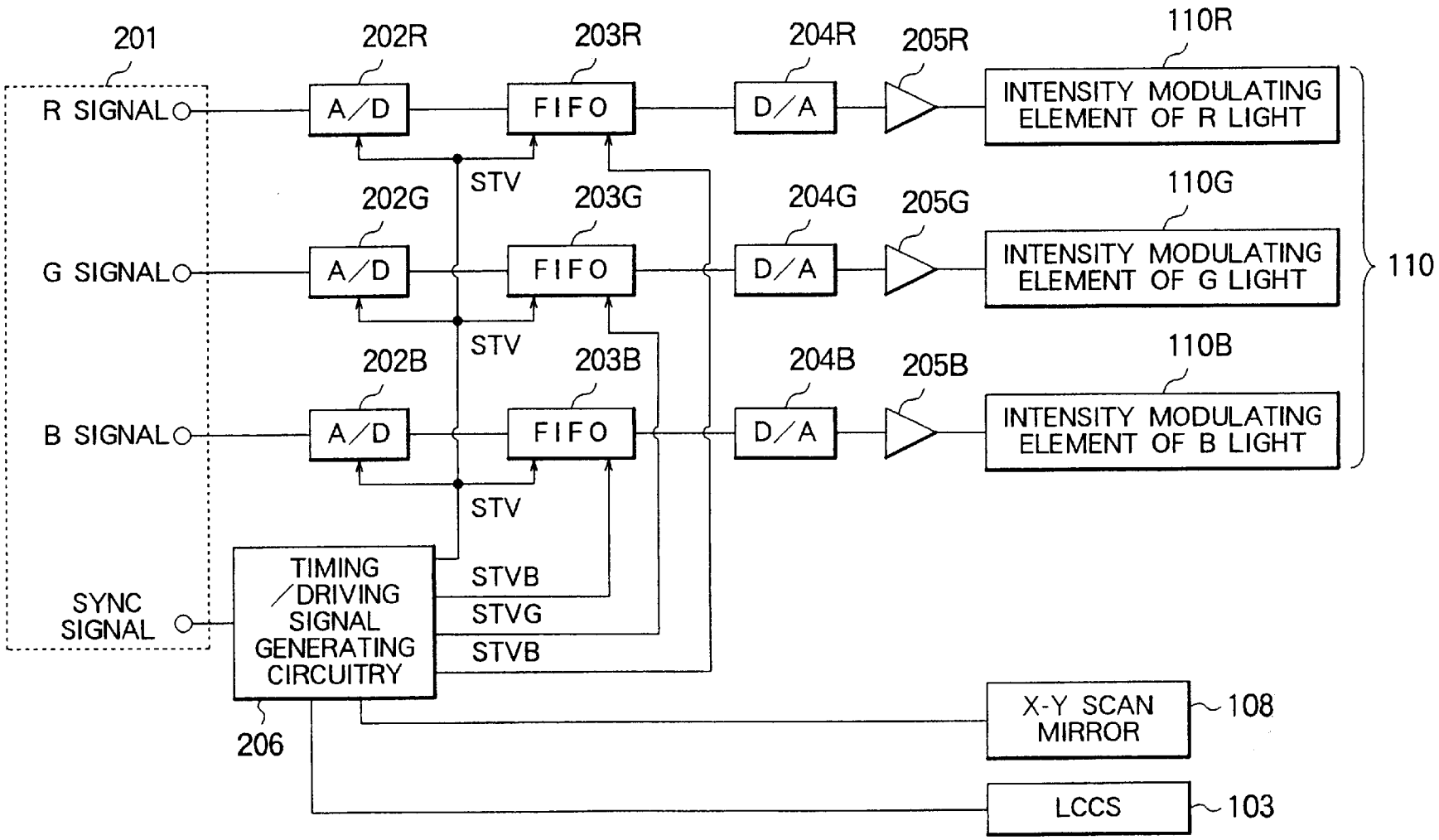
FIG. 25 is a block diagram showing an example of a constitution of a driving part of a display device of the present invention.

FIG. 25 is a block diagram showing an example of a constitution of a driving part of a display device of the present invention.

Here, a constitution in which, with use of the RGB display signals, and an SYNC including vertical, horizontal synchronizing signals, modulating elements 110R, 110G, 110B, X-Y scan mirrors, which are scanning means, 108R, 108G, 108B, and an LCCS 102 are driven is shown. As aforementioned, driving of the LCCS 102 is carried out by driving liquid crystal cells 401, 402 constituting this LCCS. Further, though not shown in the figure, clock is given to respective portion.

The RGB display data signals supplied from a signal source 201 such as an external circuitry with its frame frequency are A/D converted, by A/D converters (Analogue-Digital Converter) 202R, 202G, 202B, with a period (STV) of a frame frequency of the display device. Frame memories (FIFO) 203R, 203G, 203B take in the A/D converted data signals with a period (STV) of a frame frequency. Taking in of these RGB signals may be carried out with the same timing.

Thereafter, the data signals stored in the frame memories 203R, 203G, 203B are read out coinciding with timings STV, STVG, STVB with which the X-Y scan mirrors 108R, 108G, 108B scan. The taken out signals are D/A converted with the D/A converters 204R, 204G, 204B, fed to the modulating elements 110R, 110G, 110B through operational amplifiers 205R, 205G, 205B.

Incidentally, signals controlling the driving timings of the A/D converters 202R, 202G, 202B, the frame memories (FIFO) 203R, 203G, 203B are fed to the A/D converters, the frame memories as pulses such as STV, STVR, STVG, STVB. The STV, STVR, STVG, STVB are generated, by a timing/driving signal generating circuitry 206, based on the SYNC signals including vertical synchronizing signals, horizontal synchronizing signals.

Figure 26:
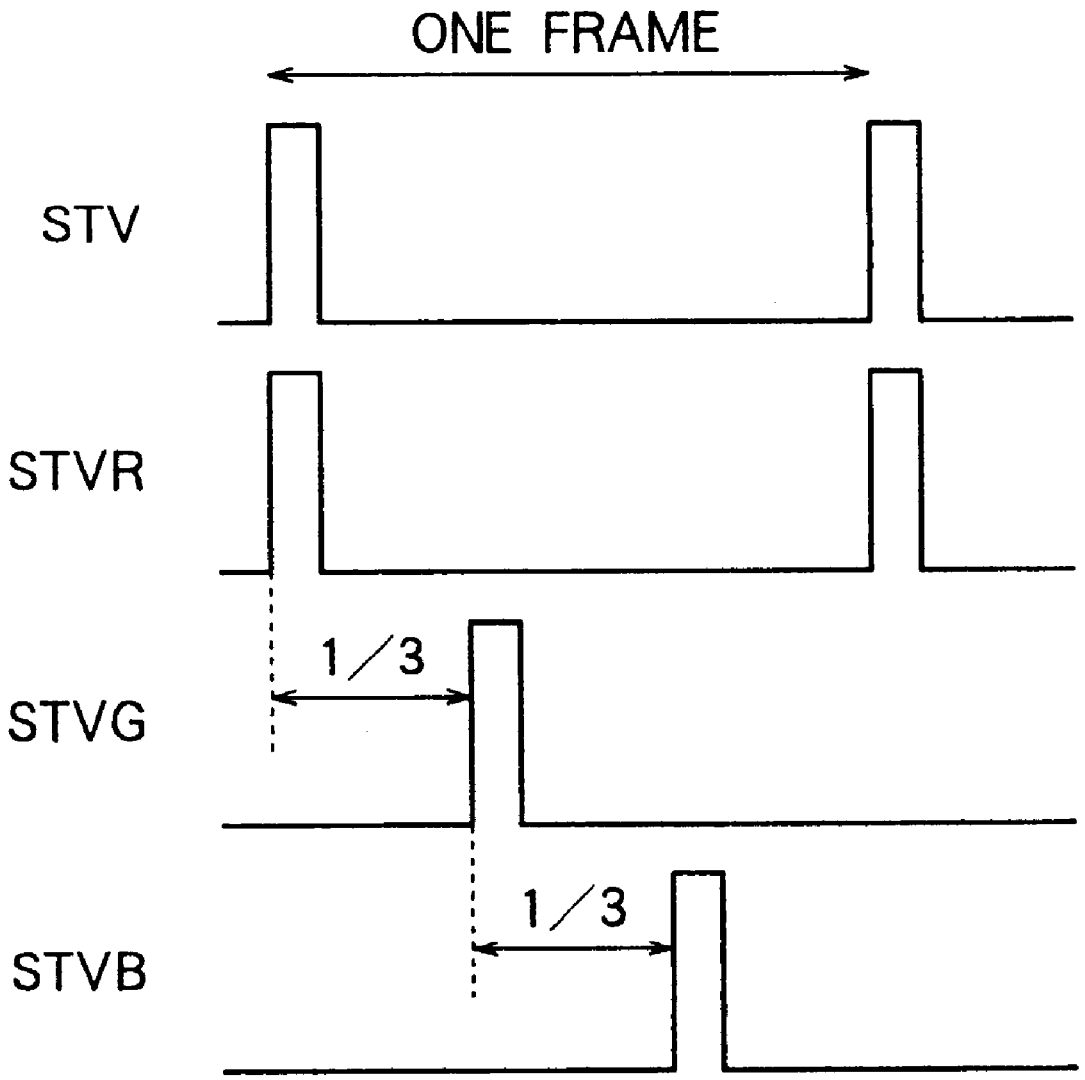
FIG. 26 is a diagram showing examples of pulses to be inputted in an A/D converter, a frame-memory.

FIG. 26 is a diagram showing examples of waveforms of STVR, STVG, STVB. In this case, the positions where the lights drawing respective images of RGB scan the screen 100 are displaced by ⅓ with respect to the screen 100 (refer to FIG. 23, FIG. 24A, and FIG. 24B). Therefore, the STVR, STVG, STVB are trigger signals displaced by ⅓ in one frame period.

In the case of the display device of the present invention described in embodiment 11, scanning can be carried out with the period identical with the frame frequency.

Figure 27:
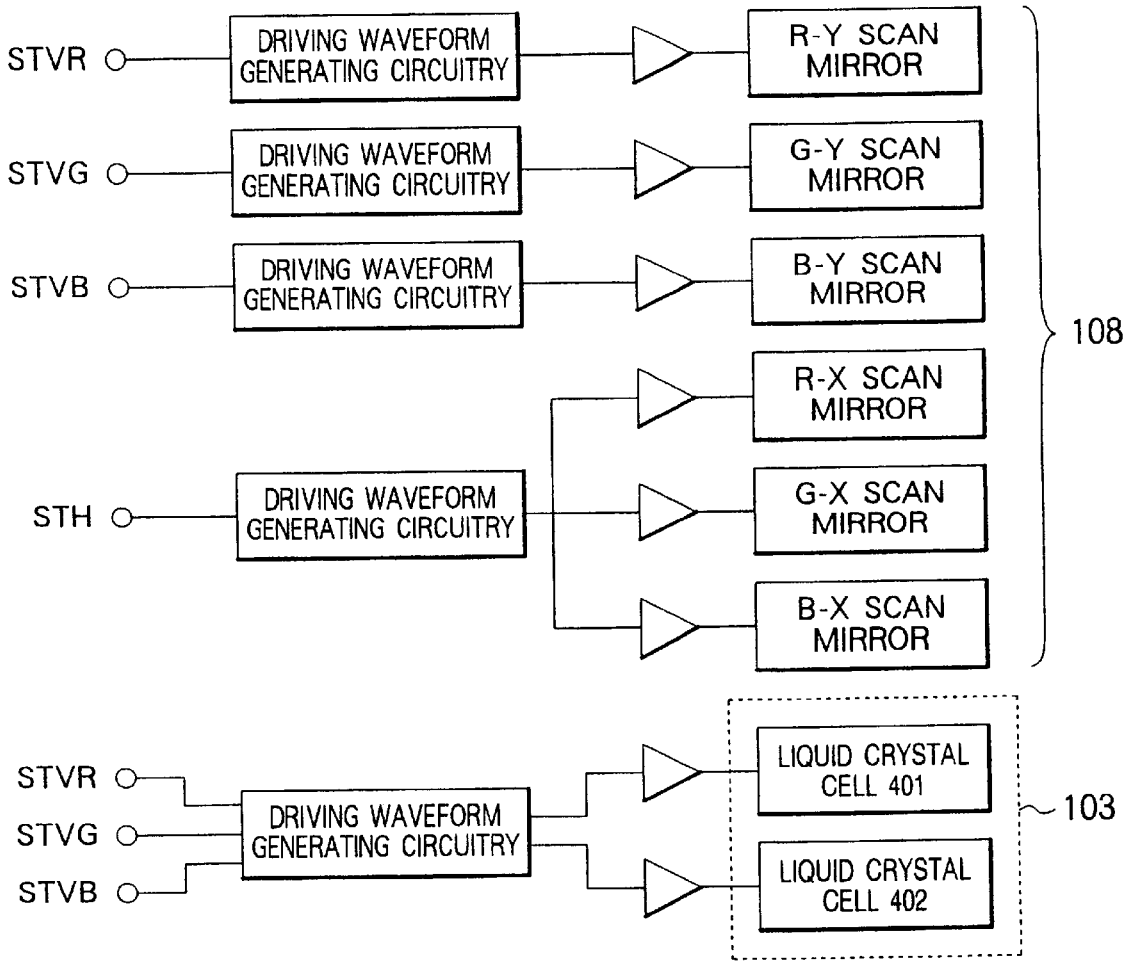
FIG. 27 is a block diagram diagrammatically showing a constitution for carrying out timing control to drive a scanning means and a liquid crystal color shutter.

FIG. 27 is a block diagram showing diagrammatically a constitution for carrying out timing control for driving scanning means 108 and liquid crystal color shutters 103.

The Y scan mirror is scanned with the period (RTW) identical with the frame frequency. However, as aforementioned, the positions on the screen to be scanned are different for respective beams of RGB. Therefore, as the trigger signals, for instance, the trigger signals STVR, STVG, STVB for reading in the data signals can be employed.

The X scan mirror scans the light from the light source on the screen with a horizontal frequency. The light drawing respective colors of RGB can be made to scan with the identical period (STH) with the horizontal frequency.

In order to drive the LCCS, the liquid crystal cell 401, the liquid crystal cell 402 are required to be inputted voltage of different wave forms respectively. However, with trigger signals STVR, STVG, STVB of the RGB images, and clock signals, the wave forms which realize the driving timings illustrated in, for instance, FIG. 23, FIG. 24A, and FIG. 24B, need only to be generated.

Incidentally, here, a constitution, where analogue signal is fed from the signal source, and the analogue signal is also fed to the intensity modulating element 110 to drive, is described as an example. However, a constitution in which modulating elements 110, scanning means 108, an LCCS 102 are driven by digital signals can be also adopted. In this case, all the constitution of the driving parts of the display device of the present invention illustrated in FIG. 25 can be constituted with the digital circuitry.

(Embodiment 13)

Figure 28:
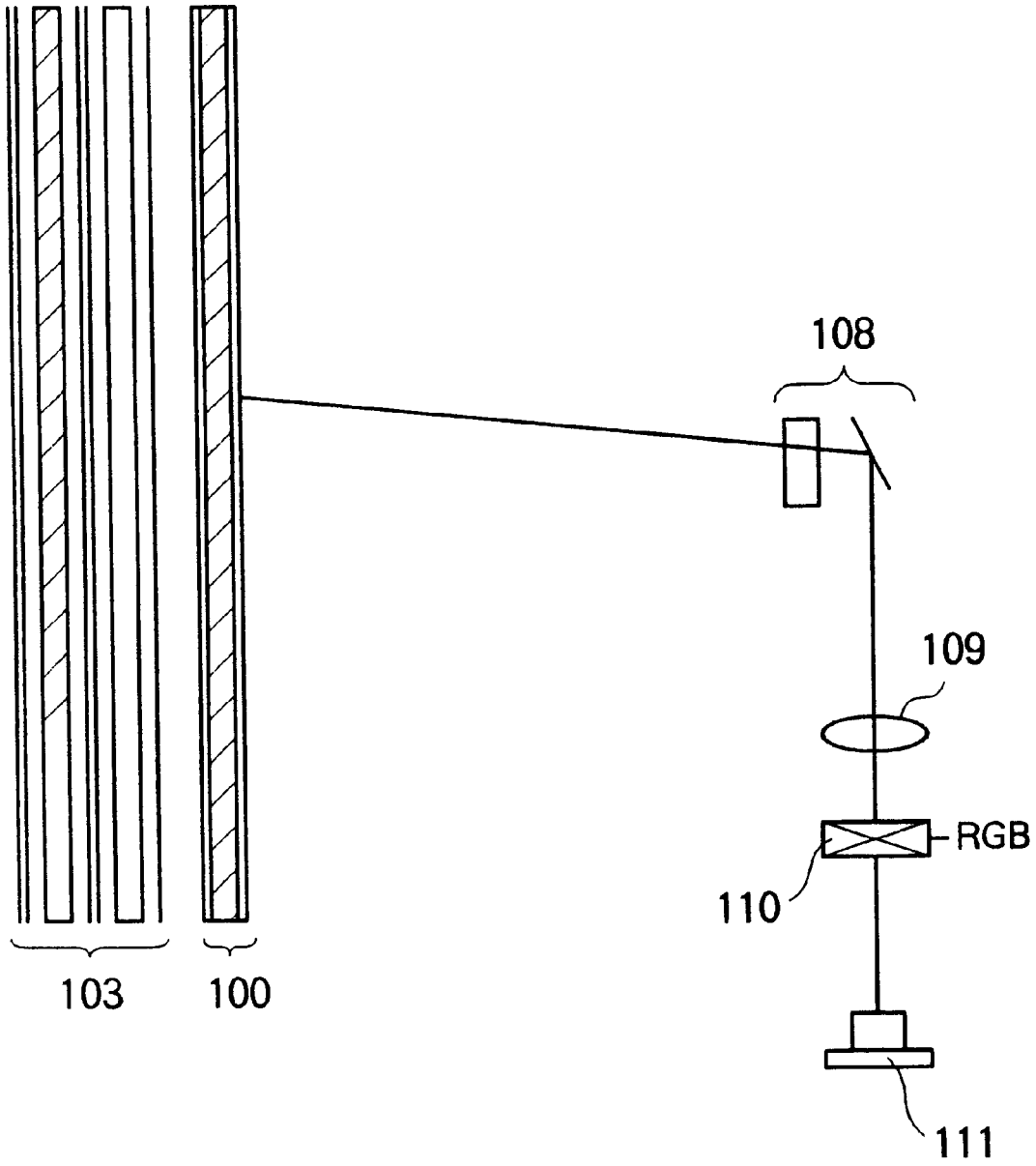
FIG. 28 is a diagram diagrammatically showing still another example of a constitution of a display device of the present invention.

FIG. 28 is a diagram showing an example of still another constitution of a display device of the present invention. In this display device, beam source and drawing optics are made in one body to be one channel for all the RGB.

To a modulating element 110*a* which is a means for modulating the intensity of the source light according to data signals, data signals obtained by sequentially converting the RGB images are inputted. Further, the X-Y scan mirror 108, the modulating element 110*a*, the LCCS 102*a* are driven with the speed three times (frame frequency: 180 Hz) that of the display device of the present invention described in embodiment 11. Since the source light draws an R image, a G image, a B image during one frame period, an color image can be displayed.

(Embodiment 14)

In the display device of the present invention, the angle of incidence of the light incident on the phosphor layer 101 through scanning by the X-Y scan mirror is different from each other at the center portion and the edge portion of the screen.

When the diameter of the source light is smaller than the size of the pixel of the image to be drawn, the angle of incidence of the light to the screen does not matter particularly. Further, when the intensity of the emission of the phosphor varies due to the angle of incidence, the difference can be compensated for by modulating the intensity of the source light with the modulating means 110.

On the light incident face side of the phosphor layer 101, an adjusting means of adjusting the angle of incidence of the incident light such as a diffraction grating, a holographic optical element (HOE) may be disposed. Thereby, the light modulated in its intensity according to the thickness of the phosphor layer, the property of the phosphor, the size of the screen 100 can be irradiated with directions more close to normal direction of the screen 100.

Figure 29:
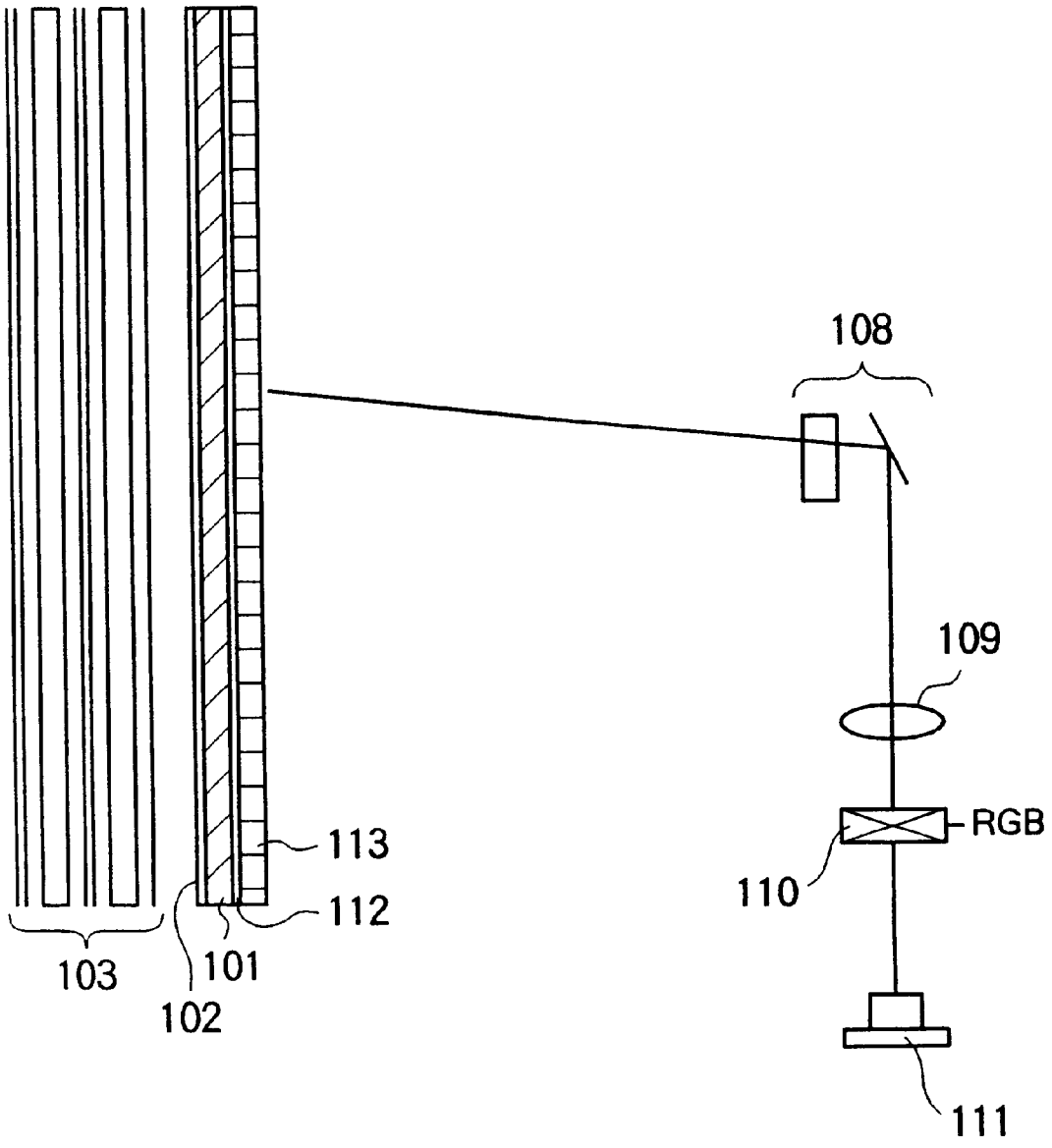
FIG. 29 is a diagram diagrammatically showing still another example of a constitution of a display device of the present invention.

FIG. 29 is a diagram showing diagrammatically still another example of a constitution of a display device of the present invention. This display device is provided with a diffraction grating 113 on a source light incident face side of a dichroic mirror 112.

The diffraction grating 113 is blazed in such a manner that the difference of the angle of incidence of the light from the light source which is scanned by the XY scan mirror 108 is as small as possible between the center portion and the edge portion of the phosphor layer 101. Incidentally, the diffraction grating 113 and the HOE, if they can make the direction of the light incident on the phosphor layer 101 more close to the normal direction of the screen, can obtain the identical effect.

Figure 30:
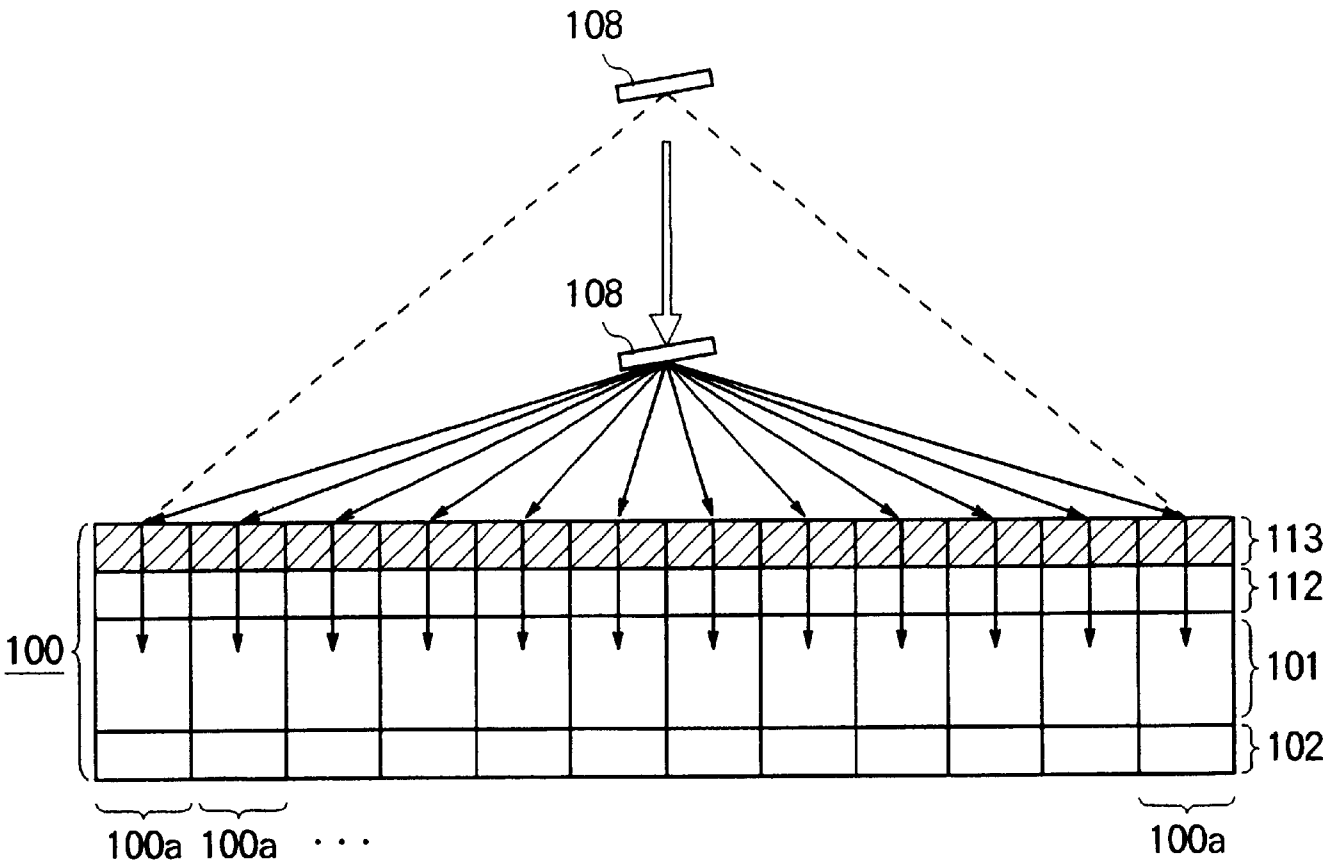
FIG. 30 is a diagram diagrammatically showing still another example of a constitution of a display device of the present invention.

FIG. 30 is a diagram schematically showing a screen 100 thereon a diffraction grating 113 is disposed.

By adopting such a constitution, irrespective of the relative position of the XY scan mirror 108 and the unit pixel area 100*a* of the screen 100, the intensity modulated source light can be made to enter the phosphor layer 101 efficiently and with uniform angle.

Further, by providing such a diffraction grating 113, distance between the XY scan mirror 108 and the screen 100 can be made small. Therefore, the thickness of the display device can be made thin. In addition, the larger size display can be made possible.

(Embodiment 15)

Figure 31:
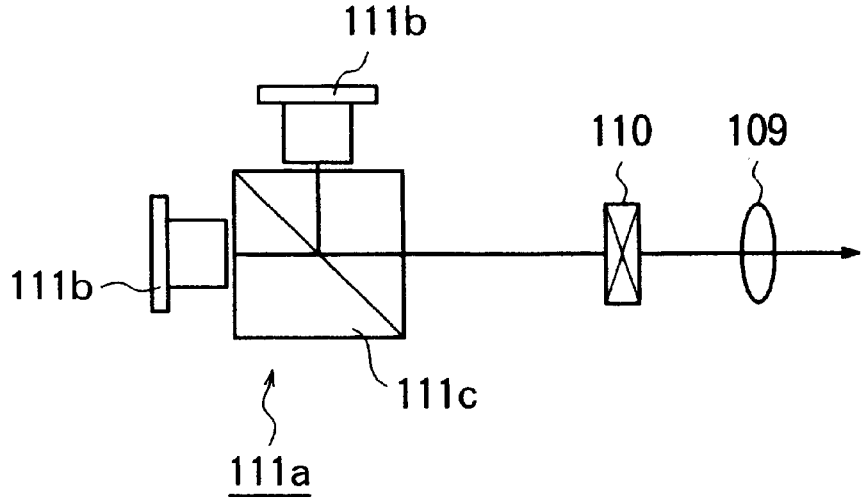
FIG. 31 is a diagram diagrammatically showing another example of a constitution of a light source of a display device of the present invention.

FIG. 31 is a diagram showing diagrammatically another example of a constitution of a light source of a display device of the present invention.

In this light source 111*a,* 2 pieces of InGaN semiconductor lasers 111*b* are disposed for the respective light sources, light flux from a plurality of semiconductor lasers is synthesized with a polarization beam-splitter 111*c*.

Since the laser light is generally the polarized light, by making use of such a polarization beam-splitter, the light flux can be easily synthesized. By adopting such a constitution, the intensity of the light outputted from the light source can be made large. Therefore, more bright display can be carried out. In addition, display of more large screen can be carried out.

(Embodiment 16)

Figure 32:
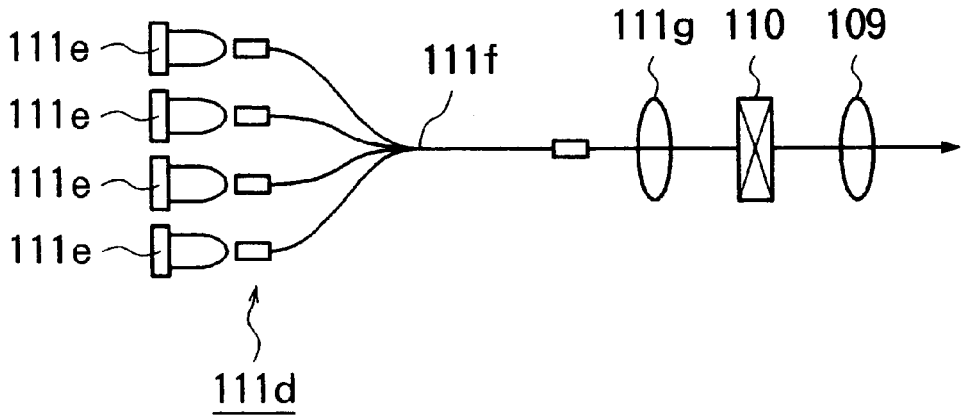
FIG. 32 is a diagram diagrammatically showing another example of a constitution of a light source of a display device of the present invention.

FIG. 32 is a diagram showing diagrammatically another example of a constitution of a light source of a display device of the present invention. This light source 111*d* is obtained by disposing InGaN LEDs 111*e* in array. The outputting source lights are synthesized by an optical fiber 111*f* and condensed by a relay-lens 111*g*. And, with the aforementioned optical system 109, on the screen 100 thereon the phosphor layer 101 is disposed, is focused on the pixel area in spot. By employing such a light source portion, with a constitution more simple than a laser light source, less expensive LED can be employed as a light source.

As described above, according to a display device of the present invention, a display device of a simple constitution, easy in obtaining a large screen, high brightness and high image quality can be provided. Further, in the display device of the present invention, the optical system of the drawing beams to the display area is not required to be disposed in a bulky decompressed container such as a CRT. Therefore, the display device can be made light.

Further, in the display device of the present invention, charged particles are not required to be used as the drawing beam. Therefore, it is not likely to be affected by the external disturbance such as noise and the like, reliability of the display device can be improved.

What is claimed is:

1. A display device, comprising:

displaying means for displaying luminous images corresponding to color information, including a screen having a phosphor layer emitting a light according to information of the luminous images;

first selecting means to selectively transmit a light having a first mode of polarization and to reflect a light except the light having the first mode of polarization, the first selecting means being disposed closely opposite to the phosphor layer so that the emitted light from the phosphor layer is introduced to the first selecting means; and, second selecting means to selectively transmit light has the first mode of polarization so that a light output having at least one of primary colors corresponding to the color information, the second selecting means being disposed on the first selecting means.

2. A display device as set forth in claim 1, wherein the displaying means displays the luminous images with a grayscale corresponding to the color information.

3. A display device as set forth in claim 2, wherein the displaying means is capable of displaying the luminous images with a field sequential aide division.

4. A display device as set forth in claim 1, wherein the displaying means comprises at least a CRT, and the CRT being disposed so as to form one screen.

5. A display device as set forth in claim 1, wherein the first selecting means selectively transmit one of a pair of circularly polarized light having a screw axis perpendicular to the screen.

6. A display device as set forth in claim 1, wherein the first selecting means comprises a non-absorbing polarizing element.

7. A display device as set forth in claim 1, wherein the second selecting means selects the light to transmit so that a color of the light output is synchronized to the color information.

8. A display device as set forth in claim 1, wherein the second selecting means is a liquid crystal color shutter capable of switching at least three primary colors.

9. A display device as set forth in claim 1, wherein the displaying means further comprises, at least a beam source emitting a convergent light beam having substantially a monochromatic wave length, modulating means to modulate an intensity of the light beam corresponding to data signal including the color information, and scanning means to scan the light beam onto the phosphor layer, and wherein the phosphor layer emitting a light including a visible light upon irradiation with the light beam.

10. A display device as set forth in claim 1, wherein the distance between the first selecting means and the phosphor layer is 1 mm or less.

11. A display device as set forth in claim 1, wherein the first selecting means is in contact with the screen.

12. A display device as set forth in claim 11, wherein the first selecting means and the screen are adhered with a transparent adhesive matched to the surface of the first selecting means in refractive index.

13. A display device as set forth in claim 1, wherein the first selecting means is formed integrally within the screen.

14. A display divice as set forth in claim 1, wherein the first selecting means includes a prism-mirror in which dielectric multiple layers are disposed slantingly to a propagating direction of an incident light from the phosphor layer.

15. A display device as set forth in claim 1, wherein the first selecting means includes an anisotropic dichroic mirror having stacked birefringent polymer films.

16. A display device as set forth in claim 1, wherein the first selecting means includes a layer of cholesteric liquid crystal polymer.

17. A display device as set forth in claim 16, herein the layer of cholesteric liquid crystal polymer has continuously varying screw pitches.

18. A display device as set forth in claim 16, wherein the first selecting means further includes a quarter-wave film disposed on the light outputting side of the layer of cholesteric liquid crystal polymer.

19. A display device as ser forth in claim 1, wherein the first selecting means includes at least three layers of cholesteric liquid crystal polymers having different screw pitches.

20. A display device as set forth in claim 1, wherein light reflected by the first selecting means is recurrently reflected and polarized by the phosphor layer, and wherein the first selecting means selectively transmits the polarized light having the first mode of polarization and reflects light except the polarized light having the first mode of polarization.

21. A display device, comprising:

a CRT for displaying luminous images corresponding to color information, including a screen having a phosphor layer emitting a light according to information of the luminous images;

a polarization converting element to selectively transmit a light having a first mode of polarization and to reflect a light except the light having the first mode of polarization, the polarization converting element being disposed closely opposite to the phosphor layer so that the emitted light from the phosphor layer is introduced to a first layer; and, a liquid crystal color shutter to selectively transmit light having the first mode of polarization so that a light output having at least one of primary colors corresponding to the color information, the liquid crystal color shutter being disposed on the polarization converting element.

22. A display device as set forth in claim 21, wherein the polarization converting element comprises a polymer film having optical anisotropy.

23. A display device as set forth in claim 21, wherein the liquid crystal color shutter selects the light to transmit so that a color of the light output is synchronized to the color information.

24. A display device as set forth in claim 21, wherein the distance between the polarization converting element and the phosphor layer is 1 mm or less.

25. A display device as set forth in claim 21, wherein the polarization converting element is in contact with the screen.

* * * * *

UNITED STATES PATENT AND TRADEMARK OFFICE

CERTIFICATE OF CORRECTION

PATENT NO. : 6,333,724 B1
DATED : December 25, 2001
INVENTOR(S) : Kazuki Taira et al.

It is certified that error appears in the above-identified patent and that said Letters Patent is hereby corrected as shown below:

Column 1,
Line 29, after “displays” insert -- they --;
Line 35, delete “using” (second occurrence).

Column 2,
Line 40, delete “a”.

Column 3,
Line 66, change “arranged” to -- arranging --.

Column 6,
Line 22, delete “a”;
Line 36, after “source” insert -- which --.

Column 7,
Line 16, change “coloriziing” to -- colorizing --;
Line 54, after “transmitted” insert -- through --.

Column 8,
Line 38, after “controlling” insert -- of --;
Line 45, after “out” insert -- in --.

Column 9,
Line 5, after “phase” insert -- by --;
Line 12, change “form” to -- from --;
Line 14, change “the” (second occurrence) to -- as --.

Column 10,
Line 8, change “is” to -- has --;
Line 11, delete “of”;
Line 18, changed “th e” to -- the --;
Line 57, after “transmitted” insert -- to --.

UNITED STATES PATENT AND TRADEMARK OFFICE

CERTIFICATE OF CORRECTION

PATENT NO. : 6,333,724 B1
DATED : December 25, 2001
INVENTOR(S) : Kazuki Taira et al.

It is certified that error appears in the above-identified patent and that said Letters Patent is hereby corrected as shown below:

Column 12,
Line 58, change “s mall” to -- small --.

Column 16,
Line 53, after “transmitted” insert -- by --.

Column 17,
Line 18, delete “explained”.

Column 20,
Line 17, change “multiply” to -- multiple --.

Column 21,
Line 16, after “images” insert -- are --;
Line 42, after “101” insert -- , which --.

Column 29,
Line 13, change “herein” to -- wherein --.
Line 20, change “ser” to -- set --.

Signed and Sealed this

Thirtieth Day of July, 2002

*Attest:*

*Attesting Officer*

JAMES E. ROGAN
*Director of the United States Patent and Trademark Office*